US005184709A

United States Patent [19]

Nishiumi et al.

[11] Patent Number: 5,184,709

[45] Date of Patent: Feb. 9, 1993

[54] COIN SELECTOR

[75] Inventors: Kenji Nishiumi, Sakado; Kenji Nakajima, Saitama; Mitsugu Mikami, Kawagoe; Takeshi Ishida, Sakado; Yukio Ito, Niiza, all of Japan

[73] Assignee: Kabushiki Kaisha Nippon Conlux, Tokyo, Japan

[21] Appl. No.: 741,901

[22] Filed: Aug. 8, 1991

[30] Foreign Application Priority Data

Aug. 14, 1990 [JP] Japan ..... 2-214819
Aug. 30, 1990 [JP] Japan ..... 2-229255

[51] Int. Cl.[5] ..... G07D 3/00

[52] U.S. Cl. ..... 194/318; 194/343; 194/203; 194/348; 194/346; 194/351; 271/273; 453/56; 453/17; 453/3

[58] Field of Search ..... 194/206, 207, 346-348, 194/343, 351, 317, 318, 217, 203; 453/56, 16, 17, 3, 4, 20, 21.2; 271/273, 274; 198/626.2-626.4

[56] References Cited

U.S. PATENT DOCUMENTS 2,995,976 8/1961 Weingart .
3,347,249 10/1967 Becker .
3,621,854 11/1971 Redman .
3,667,485 6/1972 Sesko .
3,939,954 2/1976 Collins .
4,017,169 4/1977 Komura et al. ..... 271/273 X
4,228,811 10/1980 Tanaka et al. .
4,286,703 9/1981 Schuller et al. .
4,318,484 3/1982 Stiernspetz .
4,374,529 2/1983 Kobayashi et al. ..... 453/17
4,491,140 1/1985 Eglise et al. ..... 194/217
4,570,923 2/1986 Hooper et al. ..... 271/273 X
4,850,468 7/1989 Kobayashi et al. .
4,850,469 7/1989 Hayashi et al. .

FOREIGN PATENT DOCUMENTS 2338315 2/1974 Fed. Rep. of Germany ..... 194/346
2263973 10/1974 Fed. Rep. of Germany .
3022794 3/1981 Fed. Rep. of Germany .
2634301 1/1990 France .
62-245495 10/1987 Japan .
62-266692 11/1987 Japan .
1-232490 9/1989 Japan ..... 194/348
646000 10/1984 Switzerland ..... 194/351
1405085 6/1988 U.S.S.R. ..... 194/346
2137793 10/1984 United Kingdom .

*Primary Examiner*—Michael S. Huppert
*Assistant Examiner*—William M. Hienz
*Attorney, Agent, or Firm*—Diller, Ramik & Wight

[57] ABSTRACT

A coin selector includes a single coin passage and a single coin rolling-down passage. The coin passage is equipped with a coin discriminating mechanism so as to discriminate whether a coin inserted through a coin insert slit is a true coin or a false coin, and moreover, discriminate the kind of the coin which has been recognized as a true coin. On the other hand, the coin rolling-down passage is equipped with a coin distributing mechanism so as to selectively distribute the true coin conveyed from the coin passage depending on the kind of each coin. Conculsively, the coin selector is contructed in a very compact configuration.

38 Claims, 26 Drawing Sheets

COIN SELECTOR

BACKGROUND OF THE INVENTION

1. Field of the Invention

The present invention relates generally to a coin selector installed in a so-called coin treatment apparatus employable for an automatic vending machine, a coin exchanger, a monetary service unit or the like wherein a coin inserted through a coin insert slit is selectively received and stored depending on the kind of coins and some of the coins which have been selectively received and stored in that way are paid out as a change. More particularly, the present invention relates to a coin selector including a coin selecting section for discriminating whether a coin inserted through the coin insert slit is as a true coin or a false coin and then selectively distributing true coins depending on the kind of coins.

2. Description of the Related Art

To facilitate understanding of the present invention, a typical conventional coin selector will briefly be described below with reference to FIG. 33.

Generally, a conventional coin selector 1 installed in a coin treatment apparatus employable for an automatic vending machine, a coin exchanger, a monetary service unit or the like is constructed as schematically illustrated in FIG. 33, i.e., a sectional view of the coin selector 1.

A first inclined coin rolling-down passage 5 including coin discriminating means (coil sensor) 4 is formed in a housing 2 of the coin selector 1. The coin discriminating means 4 serves to discriminate whether a coin inserted through a coin insert slit 3 is a true coin or a false coin and then discriminate the kind of coins each recognized as a true coin. In addition, a second inclined coin rolling-down passage 7 and a vertical coin conveyance passage 10 are formed in a bifurcated state on the downstream side of the first coin rolling-down passage 5, and so-called rail type coin selecting means 6 is arranged peripheral to the second coin rolling-down passage 7. Specifically, the coin selecting means 6 is constructed such that each coin conveyed from the first coin rolling-down passage 5 is squeezed toward the side wall of the second coin rolling-down passage 7 so as to allow the coin to be selectively distributed in respective coin passages depending on the kind of coins. On the other hand, the vertical coin conveyance passage 10 is equipped with diameter type coin selecting means which includes a hole 8 for receiving a specific kind of coins each having a predetermined diameter and then conducting them into a coin delivery passage (not shown) as well as a tongue 9 for squeezing each coin fallen down through the vertical coin conveyance passage 10 toward the hole 8 side.

In FIG. 33, reference numeral 11 designates a lever which selectively determines a coin A inserted through the coin insert slit 3 as a true coin or a false coin in response to a detection signal transmitted from the coil sensor 4. The true coin is conducted to the second coin rolling-down passage 7 or the vertical coin conveyance passage 10, while the false coin is conducted to a payout chute (not shown) which extends from the side wall of the first coin rolling-down passage 5 at the downstream end of the same. In addition, in FIG. 33, reference numeral 12 designates another lever which serves to divide coins each recognized as a true coin based on the detection signal from the coil sensor 4 into a group of coins each having a smaller diameter or a group of coins each having a larger diameter. In detail, the true coins recognized by the coil sensor 4 are composed of four kinds of coins, i.e., a L coin, a M coin, a N coin and an 0 coin wherein a diameter of each coin is determined in accordance such an order as represented by an inequality, i.e., a diameter of each L coin > a diameter of each N coin > a diameter of each M coin > a diameter of each O coin. In the shown case, a group of coins each having a larger diameter, i.e., L coins and M coins (a diameter of each L coin > a diameter of each M coin) are conducted to the second coin rolling-down passage 7. After the coins are selected depending on a diameter of each coin by the coin selecting means 6 arranged at the intermediate location of the coin rolling-down passage 7, the coins L are conducted to a largest coin discharge passage and the coins M are conducted to a larger coin discharge passage. On the other hand, a group of coins each having a smaller diameter, i.e., the N coins and the O coins (a diameter of each N coin > a diameter of each O coin) are conducted to the vertical coin conveyance passage 10 while the lever 12 is turned to the position represented by solid lines in FIG. 33. Then, the coins are selected depending on a diameter of each coin by the diameter type coin selecting means including the hole 8 and the tongue 9 at the intermediate location of the vertical coin conveyance passage 10. After completion of the selecting operation, the N coins are conducted to a smaller coin discharge passage and the coins O are conducted to a smallest coin discharge passage.

As shown in FIG. 34, to practically use the coin selector 1 installed in an equipment such as an automatic vending machine or the like, a long coin intake chute 15 is arranged between a coin insert slit 14 fitted to a door 13 of the equipment and a coin inlet port 3 of the coin selector 1 in such a manner that the upstream end 15*a* of the chute 15 is exposed to the coin insert slit 14 and the downstream end 15*b* of the same is exposed to the coin inlet port 3. With such arrangement of the chute 15 as described above, when a coin A is inserted into the coin insert slit 14, it is delivered to the coin inlet port 3 of the coin selector 1 at an accelerated speed.

As is apparent from FIG. 33, with the conventional coin selector 1 constructed in the above-described manner, since a plurality of coin conveyance passages, i.e., the first and second coin rolling-down passages 5 and 7, the vertical coin conveyance passage 10 and a plurality of vertical coin delivery passages branched from the second coin rolling-down passage 7 are formed in the housing 2 of the coin selector 1, a dimension H of the housing 2 as measured in the vertical direction is unavoidably enlarged. For this reason, there arises a problem that the coin selector 1 is hardly constructed in smaller dimensions.

In addition, as shown in FIG. 34, since the long coin intake chute 15 is arranged between the coin insert slit 14 and the coin inlet port 3 of the coin selector 1, a space S occupied in the equipment in the vertical direction for installing the coin selector 1 is likewise enlarged. Thus, especially with respect to an automatic vending machine, there arises another problem that a space required for receiving commercial articles to be sold by the automatic vending machine is reduced undesirably. Consequently, it is practically difficult to construct the automatic vending machine in smaller dimensions with the conventional coin selector.

SUMMARY OF THE INVENTION

The present invention has been made with the foregoing background in mind.

A primary object of the present invention is to provide a coin selector which is constructed to have very small dimensions.

A secondary object of the present invention is to provide a coin selector which is constructed in smaller dimensions in such a manner that a space required for installing in an equipment such as an automatic vending machine or the like is reduced substantially.

To accomplish the primary object, the present invention provides a coin selector wherein the coin selector comprises a first coin passage including coin discriminating means for discriminating whether an inserted coin is a true coin or a false, and moreover, discriminating the kind of the coin which has been recognized as a true coin; a second inclined coin passage along which further conveyance of the coin which has been conveyed from the first coin passage is properly guided; and coin distributing means arranged peripheral to the second coin passage, the coin distributing means serving such that the forward direction of the second coin passage is normally kept opened but, when the coin which has been recognized as a true coin by the coin discriminating means is introduced into the second coin passage, the forward direction of the second coin passage is closed therewith to stop further conveyance of the true coin at a position differing depending on the kind of coin and simultaneously open a part of the bottom surface of the second coin passage at the foregoing position differing depending on the kind of coin so as to allow the coin which has been recognized as a true coin to be conducted downward of the foregoing part of the bottom surface of the second coin passage at the foregoing position differing depending on the kind of coin. With the coin selector constructed in the above-described manner, since it is required that only two coin passages, i.e., the first coin passage including coin discriminating means and the second coin passage including coin distributing means are formed in a housing of the coin selector, there is no need of forming many vertical coin passage for the purpose of selectively distributing coins. This makes it possible to substantially reduce dimensions of the housing of the coin selector as measured in the vertical direction, resulting in the coin selector being constructed in a compact manner, i.e, with smaller dimensions.

Further, to accomplish the secondary object, the present invention provides a coin selector wherein the coin selector comprises horizontal coin conveying means for forcibly conveying a coin inserted through a coin insert slit in the horizontal direction; coin discriminating means arranged at an intermediate position of the horizontal coin conveying means for discriminating whether the coin which has been conveyed is a true coin or a false coin, and moreover, discriminating the kind of the coin which has been recognized as a true coin; a single coin rolling-down passage for properly guiding further conveyance of the true coin which has been conveyed from the horizontal coin conveying means; and coin distributing means arranged peripheral to the coin rolling-down passage, the coin distributing means serving such that the forward direction of the coin rolling-down passage is normally opened but, when the coin which has been recognized as a true coin by the coin discriminating means is introduced into the coin rolling-down passage, the forward direction of the coin rolling-down passage is closed therewith to stop further conveyance of the true coin at a position differing depending on the kind of coin and simultaneously open a part of the bottom surface of the coin rolling-down passage at the foregoing position differing depending on the kind of coin so as to allow the coin which has been recognized as a true coin to be conducted downward of the foregoing part of the bottom surface of the coin rolling-down passage at the foregoing position differing depending on the kind of coin. With the coin selector constructed in the above-described manner, since a coin inserted through the coin insert slit is forcibly conveyed into the housing of the coin selector with the aid of the horizontal coin conveying means, there is no need of arranging a coin intake chute for introducing each coin into the housing of the coin selector with the aid of a dead weight of the coin itself. This makes it possible to substantially reduce a space required for installing the coin selector in an equipment such as an automatic vending machine or the like. In addition, since it is required that a single inclined coin rolling-down passage including coin distributing means is formed in the housing of the coin selector for the purpose of selectively distributing each coin depending on the kind of coin, a dimension of the housing of the coin selector as measured in the vertical direction can be reduced remarkably.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 1 is a side view which schematically illustrates that a coin selector of the present invention is installed in an equipment such as an automatic vending machine or the like;

DESCRIPTION OF THE PREFERRED EMBODIMENT

Now, the present invention will be described in detail hereinafter with reference to the accompanying drawings which illustrates a preferred embodiment of the present invention.

Figure 1:
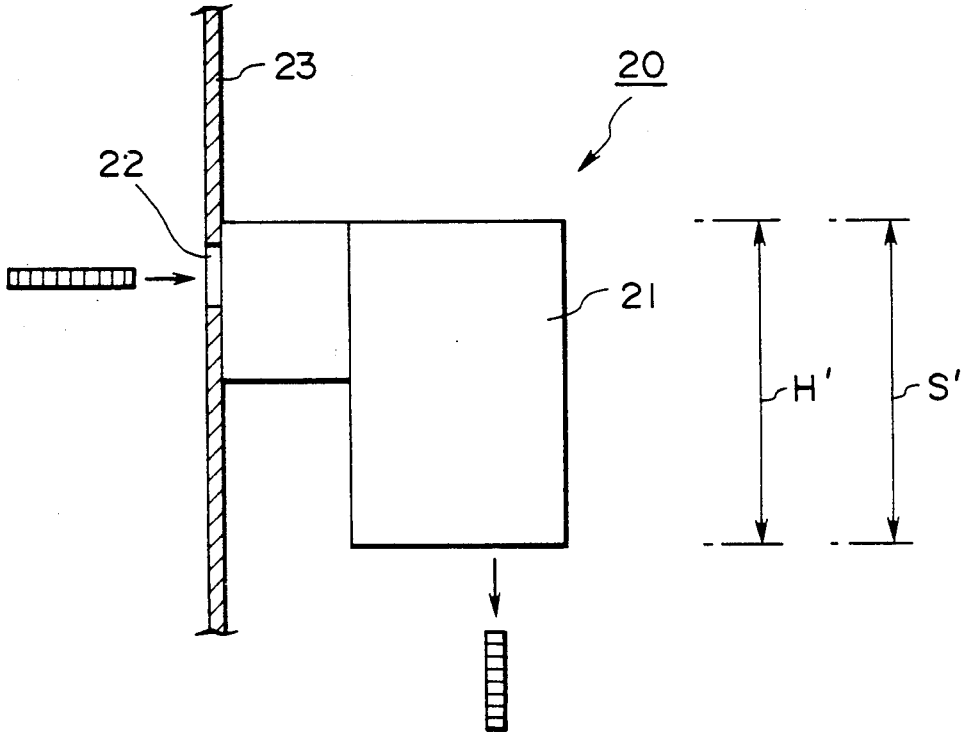

FIG. 1 is a sectional view which illustrates an essential part in an equipment such as an automatic vending machine or the like in which a coin selector 20 constructed in the embodiment of the present invention is installed. As is apparent from the drawing, a space S' occupied by the coin selector 20 in the vertical direction of the equipment is substantially equalized to a dimension H' of the coin selector 20 as measured in the vertical direction. This means that the space occupied exclusively by the coin selector 20 for the purpose of installing it in the equipment is very small and the coin selector 20 itself is constructed in a very compact configuration.

As is apparent from the drawing, the coin selector 20 includes a housing 21 having a substantially inverted L-shaped configuration as seen from the side. A coin insert slit 22 is fitted to a door 23 for the equipment such as an automatic vending machine or the like in which the coin selector 20 is fixedly installed.

Figure 2:
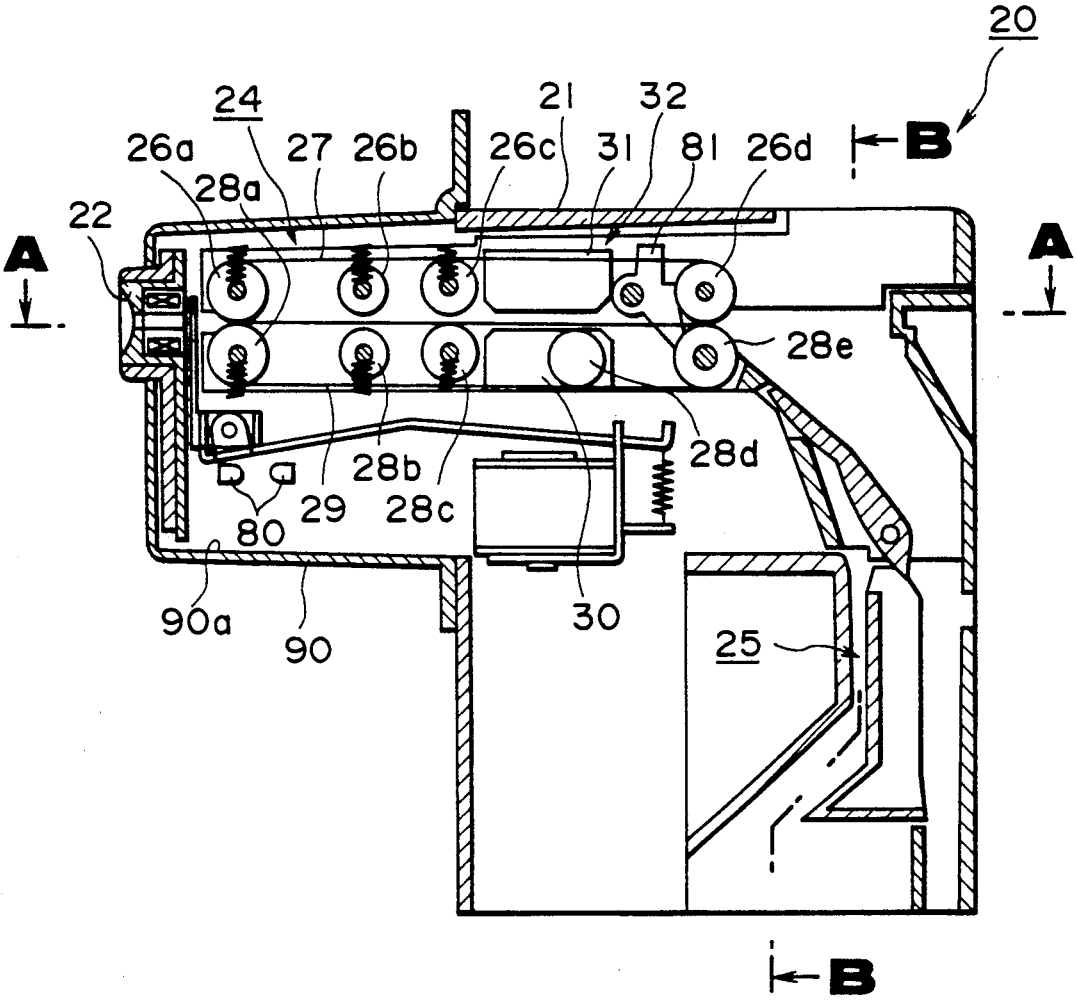
FIG. 2 is an enlarged sectional view which schematically illustrates a structure of the coin selector in accordance with an embodiment of the present invention.

As shown in FIG. 2, i.e., an enlarged schematic sectional view of the coin selector 20, the coin selector 20 is essentially composed of horizontal coin conveying means 24 and a single inclined coin rolling-down passage 25. Specifically, the horizontal coin conveying means 24 is arranged in the housing 21 so as to forcibly convey a coin inserted through the coin insert slit 22 with the aid of a pair of endless belts 27 and 29 while holding the coin therebetween, and the inclined coin rolling-down passage 25 is equipped with coin separating means (to be described later) which serve to properly separate coins conveyed via the horizontal coin conveying means depending on the kind of each coin.

As shown in FIG. 2, the horizontal coin conveying means 24 for forcibly conveying each inserted coin in the horizontal direction is composed of a group of rollers which are arranged in the form of an opposing pair in the vertical direction. An endless belt 27 molded of an elastic material such as a silicon rubber or the like is extended around a group of rollers 26*a*, 26*b*, 26*c* and 26*d* arranged on the upper side of the horizontal coin conveying means 24, while an endless belt 29 molded of an elastic material such as a silicon rubber or the like and located opposite to the endless belt 27 is extended around a group of rollers 28*a*, 28*b*, 28*c*, 28*d* and 28*e* arranged on the lower side of the same.

With the horizontal coin conveying means 24 constructed in the above-described manner, as a pair of endless belts 27 and 29 are recirculatively driven in the opposite direction relative to each other with the aid of a group of the aforementioned rollers, a coin inserted through the coin insert slit 22 is forcibly conveyed in the horizontal direction (in the rightward direction as seen in the drawing) while it is held therebetween.

It should be noted that among a group of the aforementioned rollers, the rollers 26*a*, 26*b*, 26*c*, 28*a*, 28*b* and 28*c* have springs operatively attached thereto to come in contact with each roller shaft, respectively, in order to adequately adjust a holding force for the conveying coin which has been held between the opposing pair of endless belts 27 and 29 with a squeezing force given by each spring.

In addition, coin discriminating means 32 is arranged at the intermediate position of the horizontal coin conveying means 24 so as to discriminate whether the coin which has been forcibly conveyed through the horizontal coin conveying means 24 is a true coin or a false coin, and moreover, discriminate a kind with respect to the coin which has been discriminated as a true coin. The coin discriminating means 32 is constructed in the form of a so-called coil sensor which is composed of an oscillating coil 30 and a signal receiving coil 31 arranged in the spaced relationship with a predetermined gap therebetween.

It should be noted that among a group of the aforementioned rollers, the roller 28*d*, i.e., one of the rollers arranged on the lower side of the horizontal coin conveying means 24 serves to support the coin passing past the oscillating coil 30 and the signal receiving coil 31, from below.

Figure 3:
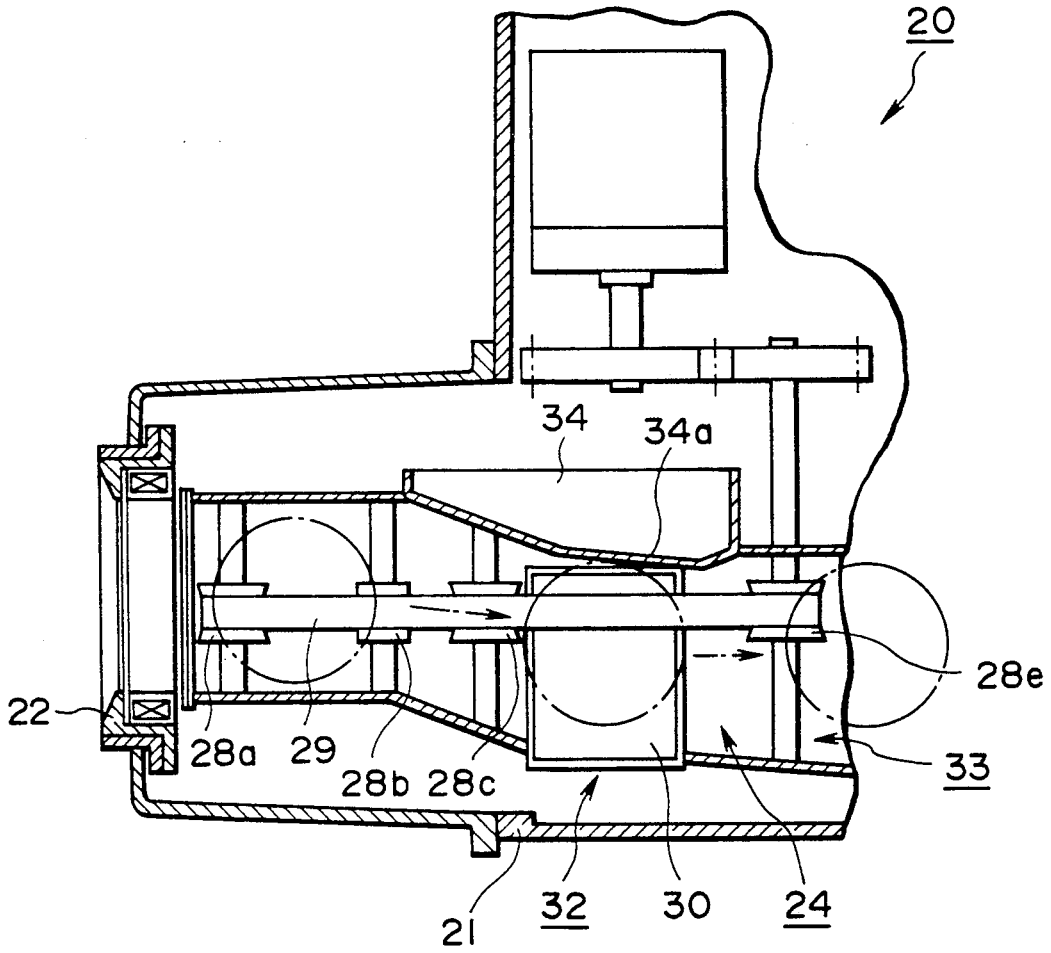
FIG. 3 is a sectional view of the coin selector taken along line A—A in FIG. 2.

As shown in FIG. 3, i.e., a fragmentary sectional view of the coin selector 20 taken along line A—A in FIG. 2, the coin selector 20 includes a coin conveying passage 33 for properly guiding conveyance of the coin (illustrated by one-dot chain lines) with the aid of the horizontal coin conveying means 24, and a guide member 34 projecting inside of the coin conveying passage 33 by a predetermined distance while exhibiting a trapezoidal shape as seen in a plan view is arranged at the intermediate position of the coin conveying passage 33 where the coin discriminating means 32 is arranged. With arrangement of the guide member 34 in that way, since the coin (illustrated by one-dot chain lines) which has been forcibly conveyed on the coin conveyance passage 33 is brought in contact with the guide member 34 without fail and then slidably moves along an inclined surface 34*a* of the guide member 34, the coin passes between the oscillating coil 30 and the signal receiving coil 31 of the coin discriminating means 32 with the inclined surface 34*a* of the guide member 34 as a reference position. Thus, incorrect discrimination of the coin discriminating means 32 due to fluctuation of the position where the coin passes between the oscillating coil 30 and the signal receiving coil 31 can be prevented as far as possible.

In FIG. 2, reference numeral 80 designates a shutter detecting sensor for detecting an opening/closing operation of a shutter portion (to be described later) which serves to open or close the coin insert slit 22, and reference numeral 81 designates a coin pulling-back preventive lever for preventing the inserted coin from being pulled back by using a fishing thread or the like with user's fingers.

Figure 4:
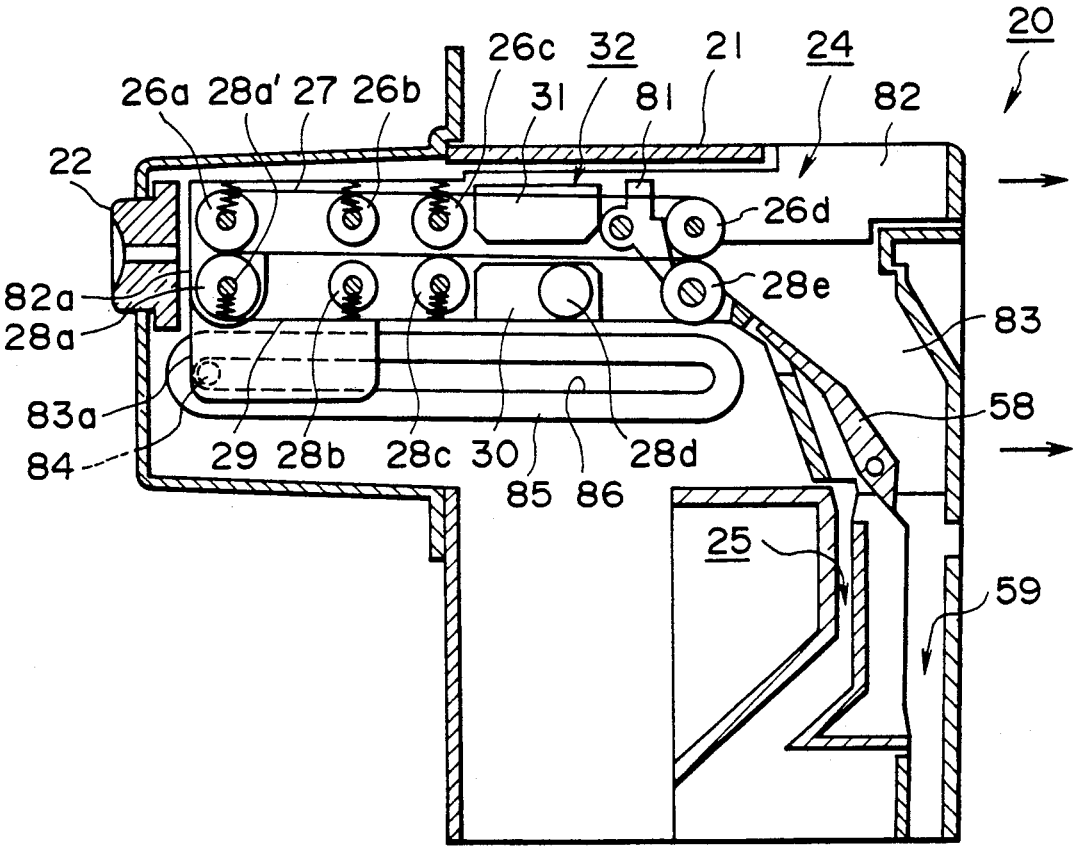
FIG. 4 is an enlarged sectional view of the coin selector, particularly illustrating that a shutter portion is removed from the coin selector for the purpose of simplification of illustration.

FIG. 4 similar to FIG. 2 is a fragmentary sectional view of the equipment such as an automatic vending machine or the like including the coin selector 20, particularly illustrating the state that the shutter portion (to be described later) for opening or closing the coin insert slit 22 is removed from the coin selector 20 for the purpose of simplification of illustration. As shown in FIG. 4, upper and lower support members 82 and 83 are arranged in the housing 21 independent of the housing 21. The upper support member 82 supports roller shafts for a group of the rollers 26*a*, 26*b*, 26*c* and 26*d* arranged on the upper side of the horizontal coin conveying means 24, while the lower support member 83 supports roller shafts for a group of the rollers 28*a*, 28*b*, 28*c* and 29*e* arranged on the lower side of the same. In addition, the upper support member 82 carries the signal receiving coil 31, while the lower support member 83 carries the oscillating coil 30. The shaft of the roller 28*d* is supported by a casing of the oscillating coil 30, and a coin distributing lever 58 for distributing each false coin into a false coin chute 59 to be described later and a true coin into a single inclined coin rolling-down passage 25 including coin distributing means to be described later is supported by the lower support member 83.

The fore end part 82*a* of the upper support member 82 is turnably supported to turn about a shaft 28*a*' which is supported at the left-hand end part of the lower support member 83 as seen in FIG. 4, and a guide shaft 84 is supported on the fore end part 83*a* of the lower support member 83. The guide shaft 84 is fitted into a guide groove 86 of a guide member 85 which is fixedly secured to the housing 21 in the region below the lower support member 83. As is apparent from FIG. 4, the guide groove 86 is formed on the guide member 85 while extending in the rightward direction as seen in the drawing.

Figure 5:
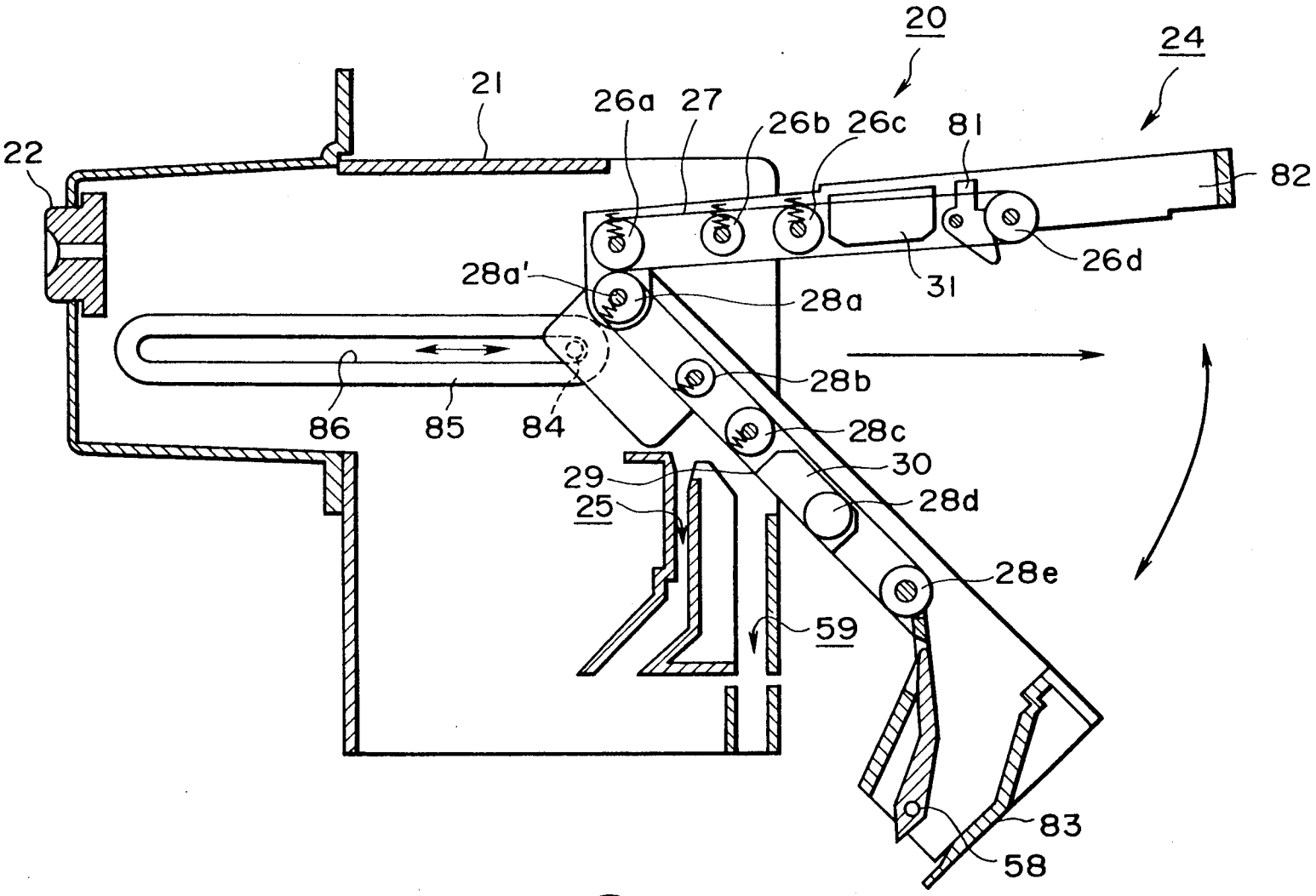
FIG. 5 is a sectional view of the coin selector, particularly illustrating that a large part of horizontal coin conveying means is displaced outside of a housing in an exposed state.

When a maintaining/inspecting operation is performed for the horizontal coin conveying means 24 constructed in the above-described manner, the upper and lower support members 82 and 83 are displaced in the rightward direction as designated by arrow marks in FIG. 4. As shown in FIG. 5 in which same components as those shown in FIG. 4 are designated by same reference numerals, the upper and lower support members 82 and 83 slidably move along the groove 86 of the guide member 85 in the horizontal direction (in the rightward direction in the drawing), causing the horizontal coin conveying means 24 to be exposed to the outside beyond the rear end surface of the housing 21.

Thereafter, when the upper and lower support members 82 and 83 are parted away from each other in the vertical direction as represented by arrow marks in FIG. 5, the upper and lower support members 82 and 83 are openably turned about the shaft 28*a*' by a predetermined angle, whereby the endless belt 29 is downwardly parted away from the endless belt 27.

Since the space between the both endless belts 27 and 29 is enlarged while the inoperative state shown in FIG. 5 is maintained, a maintaining/inspecting operation for cleaning and adjusting respective components constituting the horizontal coin conveying means 24, e.g., the endless belts 27 and 29, the respective rollers and the coin discriminating means 32 can very easily be performed by inserting a certain jig such as a wood rod covered with cotton fibers into the foregoing space.

When the horizontal coin conveying means 24 is restored in the housing 21 again after completion of the maintaining/inspecting operation, it should of course be noted that operations reverse to the foregoing ones are performed.

As shown in FIG. 2, the upstream side of the horizontal coin conveying means 24, i.e, the coin insert slit 22 side of the coin selector 20 is covered with a cover 90 having a rectangular cross-sectional shape. However, when water drops derived from rain fall or the like or a viscous liquid such as a detergent solution or the like are introduced into the interior of the coin selector 20 through the coin insert slit 22, they flow in the housing 21 along a bottom 90*a* of the cover 90 and adhere to a driving unit such as a solenoid or the like for actuating a coin distributing lever (to be described later) or the like arranged in the housing 21, causing the driving unit to be operated incorrectly. For this reason, there is a possibility that a selecting function of the coin selector 20 is deteriorated. In addition, when the viscous liquid adhering to the coin selector 20 is dried, there is another possibility that an operation of the coin selector 20 is undesirably locked, and thereby, a function of the coin selector 20 itself is interrupted.

In view of the malfunctions as mentioned above, it is recommendable that a liquid collecting portion 91 (to be described later) is attached to the bottom 90*a* of the cover 90 so as to prevent entrance of liquid in the interior of the housing 21 through the coin insert slit 22 by collecting the liquid which has flowed along the bottom 90*a* of the cover 90 and then discharging the collected liquid to the outside.

Figure 6:
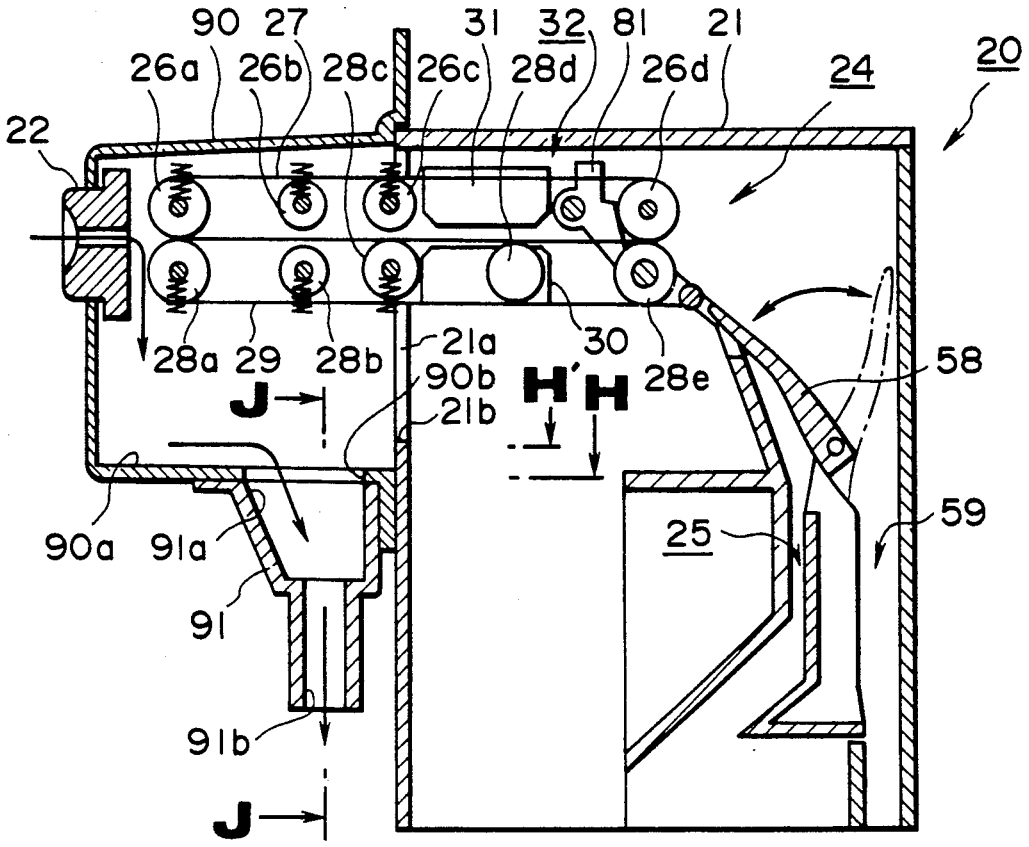
FIG. 6 is a sectional view of the coin selector, particularly illustrating that the shutter portion is removed from the coin selector for the purpose of simplification of illustration.

FIG. 6 is a fragmentary sectional view of the automatic vending machine similar to FIG. 2, particularly illustrating that the liquid collecting portion 91 is attached to the bottom 90*a* of the cover 90. In FIG. 6, same parts or components as those shown in FIG. 2 are designated by same reference numerals. It should be noted that FIG. 6 illustrates that a shutter portion 51 (to be described later) for opening or closing the coin insert slit 22 is removed from the coin selector 20 shown in FIG. 2 for the purpose of simplification of illustration.

Referring to FIG. 6, the cover 90 is designed such that a height H of the cover 90 as measured on the rear side is dimensioned to be larger than a height H' of an opening 21*a* of the housing 21 through which the horizontal coin conveying means 24 is received in the housing 21. As is apparent from the drawing, when the upstream side of the horizontal coin conveying means 24 is covered with the cover 90, the bottom 90*a* of the cover 90 is located downward of a lower edge 21*b* of the opening 21*a* with the result that the lower edge 21*b* of the opening 21*a* exhibits a function as a weir for preventing the liquid from flowing over the lower edge 21*b* of the opening 21*a*.

Figure 7:
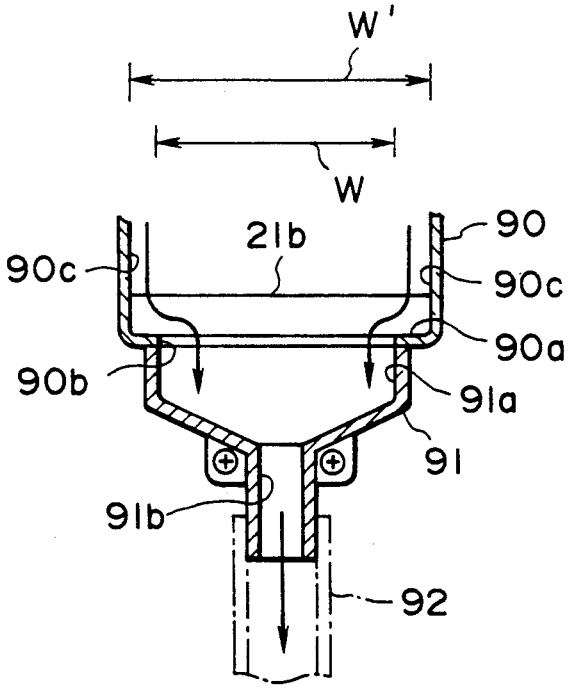
FIG. 7 is a fragmentary sectional view of the coin selector taken along line J—J in FIG. 6.

A hole 90*b* is formed through the bottom 90*a* of the cover 90. As shown in FIG. 7, i.e., a sectional view of the cover 90 taken along line J—J in FIG. 6, a width W of the hole 91*b* is dimensioned to be slightly smaller than a width W' of the cover 90. Alternatively, the width W of the hole 90*b* may be dimensioned to be equal to the width W' of the cover 90 or more than the same.

As shown in FIG. 7, the liquid collecting portion 91 having a funnel-shaped sectional contour is arranged downward of the hole 90*b*.

The liquid collecting portion 91 is communicated with the hole 90*b* and includes an opening portion 91*a* which fully surrounds the periphery of the hole 90*b*. In addition, a discharge hole 91*b* is formed through the liquid collecting portion 91 so as to allow the liquid collected in the liquid collecting portion 91 to be discharged to the outside therethrough in the arrow-marked direction as seen in the drawing.

Next, description will be made below with respect to a function of the liquid collecting portion 91.

With the coin selector 20 as shown in FIG. 6, since the upstream side of the horizontal coin conveying means 24 is covered with the cover 90 having the coin insert slit 22 received therein, the hole 90*b* is formed through the bottom 20*a* of the cover 90, and moreover, the liquid collecting portion 91 is arranged downward of the hole 90*b*, water drops derived from rain fall or a liquid such as a detergent solution flow into the housing 21 side along the bottom 90*a* of the cover 90 (as illustrated by an arrow mark in the drawing). Thus, the liquid is collected in the funnel-shaped liquid collecting portion 91 via the hole 90*b*, and thereafter, the liquid is quickly discharged to the outside through the discharge hole 91*b* which is formed downward of the liquid collecting portion 91.

In addition, water drops derived from rain fall or a liquid such as a detergent solution flowing along side surfaces 90*c* of the cover 90 through the coin insert slit 22 in the arrow-marked direction as seen in FIG. 7 are likewise collected in the liquid collecting portion 91 through the hole 90*b*, and thereafter, the liquid is quickly discharged to the outside through the discharge hole 91*b* which is formed downward of the liquid collecting portion 91.

As illustrated by one-dot chain lines in FIG. 7, it is recommendable that a liquid guide member 92 such a rubber tube or the like is fitted onto the discharge hole 91*b* of the liquid collecting portion 91 and a part of the liquid guide member 92 is exposed to the outside outward of the equipment such as an automatic vending machine or the like so as to allow the liquid flowing in the interior of the coin selector 20 through the coin insert slit 22 to be quickly discharged to the outside therethrough.

As is apparent from FIG. 6 and FIG. 7, the lower edge 21*b* of the opening 21*a* having a function of serving as a weir is intended to prevent the overflowed liquid from flowing in the interior of the housing 21 as far as possible when a large quantity of liquid flows in the interior of the coin selector 20 through the coin insert slit 22. However, the lower edge 21*b* of the opening 21*a* is not always required. Alternatively, as shown in FIG. 2, the bottom 91*a* of the cover 90 may be flush with the lower edge 21*b* of the opening 21*a*.

According to the embodiment of the present invention, the liquid collecting portion 91 having a funnel-shaped sectional contour is arranged independent of the cover 90. However, the present invention should not be limited only to this embodiment. The liquid collecting portion 91 may be made integral with the cover 90.

Figure 8:
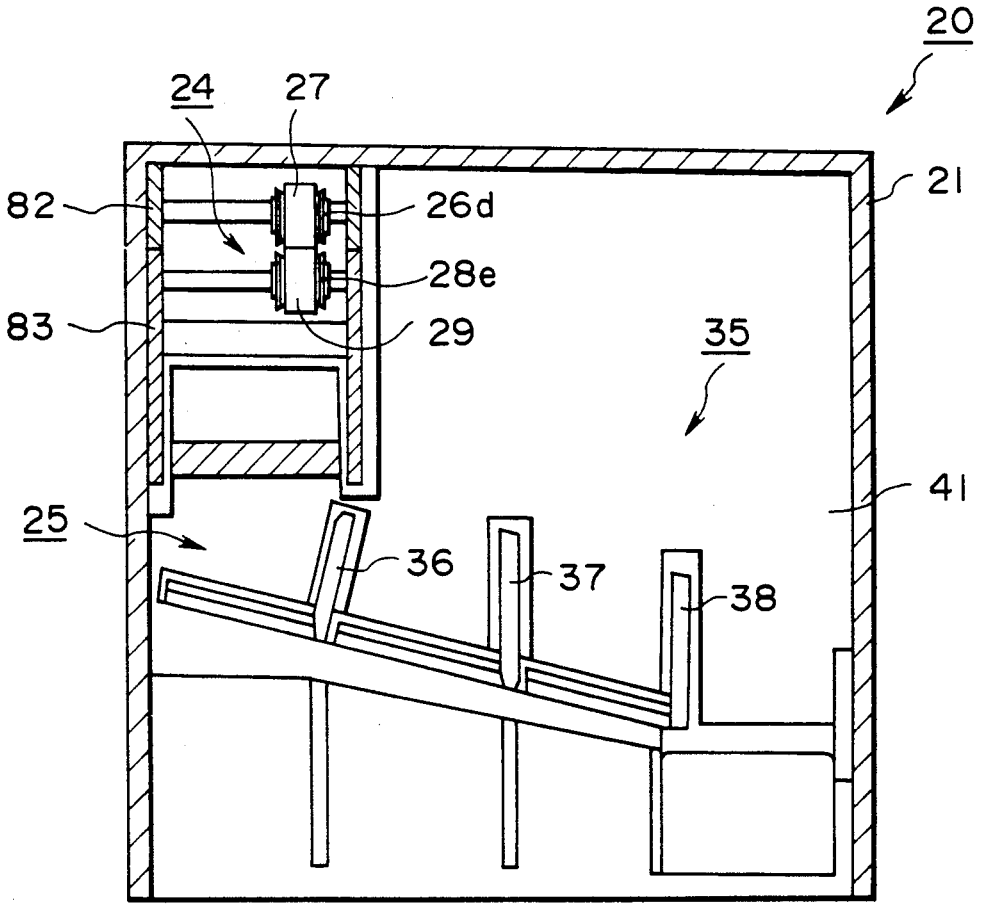
FIG. 8 is a sectional view of the coin selector taken along line B—B in FIG. 2.

As shown in FIG. 8, i.e., a fragmentary sectional view of the coin selector 20 taken along line B—B in FIG. 2, the coin selector 20 includes a single inclined coin rolling-down passage 25 in the housing 21, and the coin rolling-down passage 25 slantwise extends from the left-hand side to the right-hand side as seen in the drawing. In addition, coin distributing means 35 is arranged peripheral to the coin rolling-down passage 25. In detail, the coin distributing means 35 is constructed such that the forward direction of the coin rolling-down passage 25 is normally opened, and when the coin which has been discriminated as a true coin by the coin discriminating means 32 is introduced into the coin rolling-down passage 25, the forward direction of the coin rolling-down passage 25 is closed therewith so as to stop further conveyance of each coin at a position differing depending on the kind of each coin and then open a part of the bottom surface of the coin rolling-down passage 25 at the foregoing position differing depending the kind of each coin to conduct the coin further downward of the bottom surface of the coin rolling-down passage 25.

The coin distributing means 35 is composed of three levers 36, 37 and 38 which are successively arranged from the upstream side to the downstream side of the coin rolling-down passage 25. Each of the levers 36, 37 and 38 has a substantially L-shaped same configuration as seen in a plan view so as to permit each lever to be displaced in the vertical direction through a part of the bottom surface of the coin rolling-down passage 25 in such a manner as described below.

Next, a structure of each of the levers 36, 37 and 38 will be described below only with respect to the lever 36 for the purpose of simplification of description.

Figure 9:
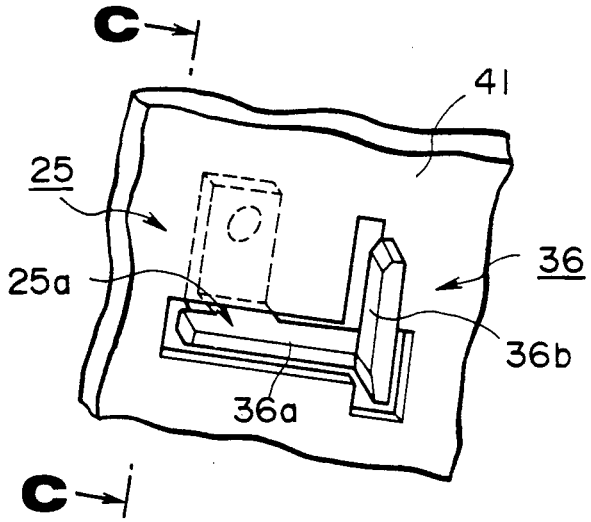
FIG. 9 is a fragmentary perspective view of the coin selector, particularly illustrating an essential part of the coin selector shown in FIG. 8.

As shown in FIG. 9, i.e, a perspective view illustrating an essential part of the coin distributing means 35 shown in FIG. 8, the lever 36 comprises an inclined surface portion 36*a* constituting a part of the bottom surface 25*a* of the coin rolling-down passage 25 when the lever 36 is displaced in the upward direction as seen in the drawing and a gate portion 36*b* integrated with the inclined surface portion 36*a* at the downstream end while standing substantially upright relative to the inclined surface portion 36*a*.

Figure 10:
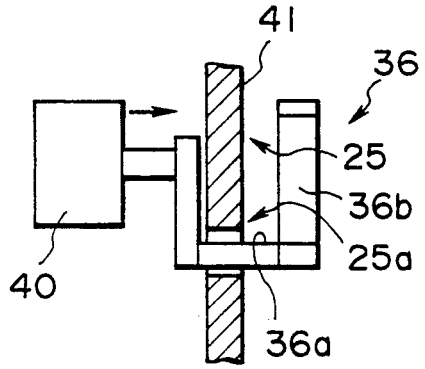
FIG. 10 is a fragmentary sectional view of the coin selector taken along line C—C in FIG. 9.

As shown in FIG. 10, i.e., a sectional view of the lever 36 taken along line C—C in FIG. 9, when the lever 36 is displaced away from a center plate 41 constituting a part of the housing 21 by a predetermined distance in the rightward direction represented by an arrow mark in the drawing with the aid of a solenoid plunger 40 adapted to be actuated based on the determination made by the coin discriminating means 32, the forward direction of the coin rolling-down passage 25 is opened in the absence of the gate portion 36*b*. At the same time, the inclined surface portion 36*a* is likewise displaced to form a part of the bottom surface 25*a* of the coin rolling-down passage 25.

Figure 11:
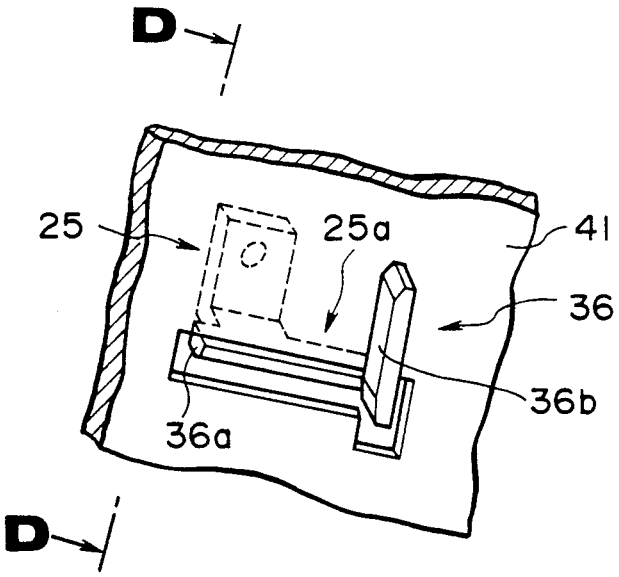
FIG. 11 is a fragmentary perspective view of the coin selector, particularly illustrating the essential part of the coin selector shown in FIG. 8.
Figure 12:
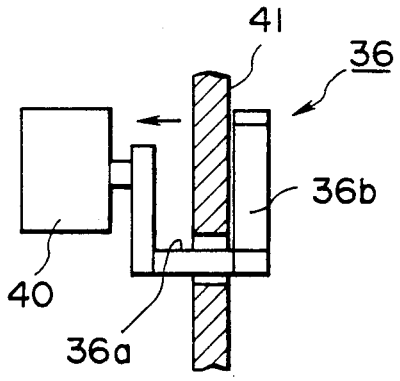
FIG. 12 is a fragmentary sectional view of the coin selector taken along line D—D in FIG. 11.

As shown in FIG. 11 and FIG. 12, i.e., a sectional view of the lever 36 taken along line D—D in FIG. 11 wherein same portions as those in FIG. 9 are designated by same reference numerals, when the lever 36 is attractively displac d toward the center plate 41 side with the aid of the solenoid plunger 40, the forward direction of the coin rolling-down passage 25 is closed with the gate portion 36*b* and the inclined surface portion 36*a* is displaced inside of the center plate 41, resulting in the bottom surface 25*a* of the coin rolling-down passage 25 is opened.

Figure 13:
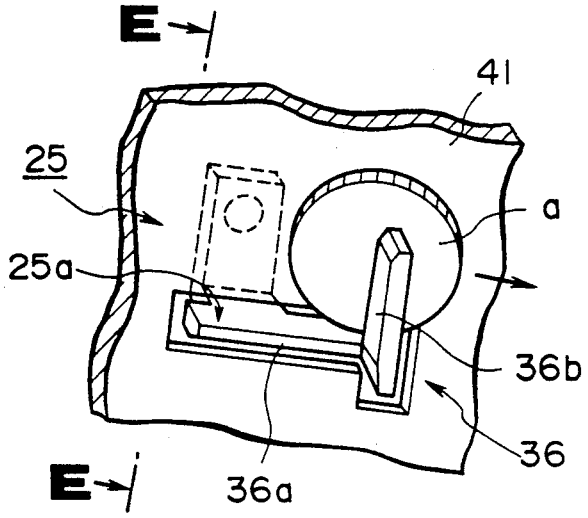
FIG. 13 is a fragmentary perspective view of the coin selector, particularly illustrating the essential part of the coin selector shown in FIG. 8.
Figure 14:
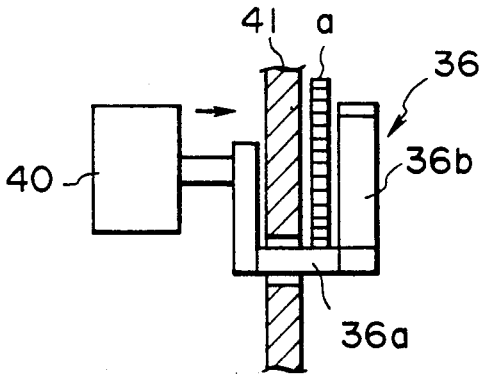
FIG. 14 is a fragmentary sectional view of the coin selector taken along line E—E in FIG. 13.

Since the lever 36 is constructed in the above-described manner, as shown in FIG. 13, i.e., a perspective view illustrating the essential portions of the lever 36 and FIG. 14, i.e., a sectional view of the lever 36 taken along line E—E in FIG. 13, when a coin is conveyed from the horizontal coin conveying means 24 (see FIG. 8) to the coin rolling-down passage 25, the lever 36 is displaced away from the center plate 41 with the aid of the solenoid plunger 40 in the rightward direction as seen in FIG. 14, whereby the forward direction of the coin rolling-down passage 25 is opened in the absence of the gate portion 36*b* and at the same time, the inclined surface portion 36*a* is likewise displaced to form a part of the bottom surface 25*a* of the coin rolling-down passage 25. This causes the coin a which has been introduced into the coin rolling-down passage 25 to pass past the lever 36. Then, the coin a is conveyed further downstream of the lever 36 on the coin rolling-down passage 25.

Figure 15:
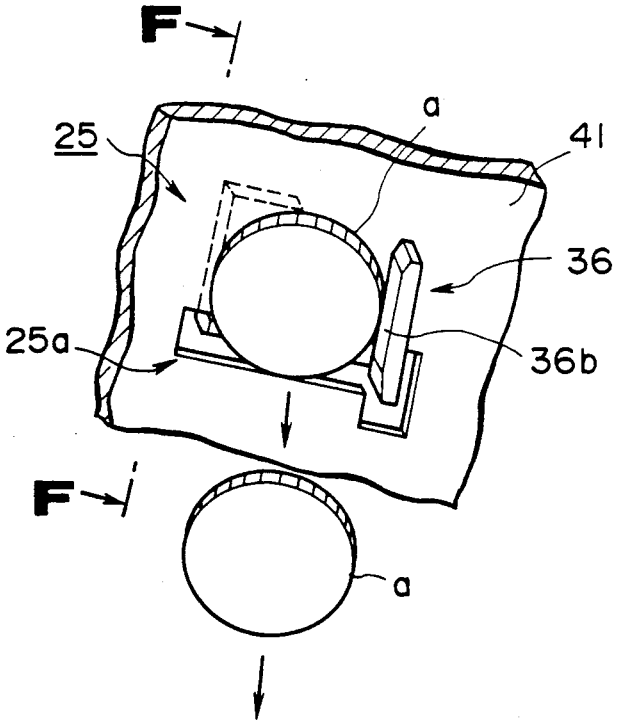
FIG. 15 is a fragmentary perspective view of the coin selector, particularly illustrating the essential part of the coin selector shown in FIG. 8.
Figure 16:
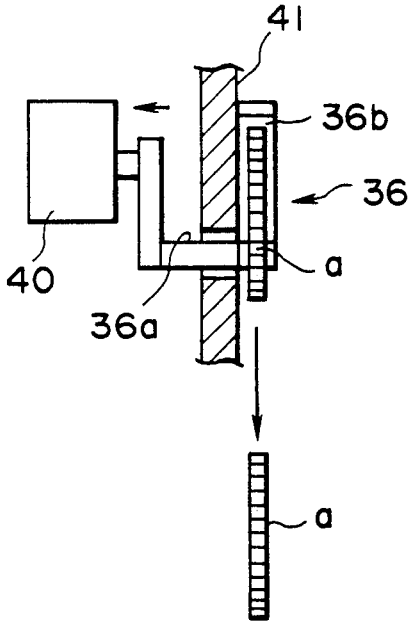
FIG. 16 is a fragmentary sectional view of the coin selector taken along line F—F in FIG. 15.

As shown in FIG. 15, i.e., an enlarged perspective view illustrating the essential portions of the lever 36 and FIG. 16, i.e., a sectional view of the lever 36 taken along line F—F in FIG. 15, when the lever 36 is attractively displaced toward the center plate 41 side with the aid of the solenoid plunger 40, the forward direction of the coin rolling-down passage 25 is closed with the gate portion 36*b* of the lever 36, and at the same time, the inclined surface portion 36*a* of the lever 36 is displaced inward of the center plate 41 thereby to open a part of the bottom surface 25*a* of the coin rolling-down passage 25. Consequently, further conveyance of the coin a which has been introduced into the coin rolling-down passage 25 is inhibited by the gate portion 36*b* of the lever 36 and the foregoing part of the bottom surface 25*a* of the coin rolling passage 25 is opened at the position where the lever 36 is arranged. Thus, the coin a is conducted downward of the foregoing position differing depending on the kind of coin, resulting in the coin a being selectively distributed.

It should be noted that different points of the other levers 37 and 38 shown in FIG. 8 from the lever 36 consists in that the positions of their arrangement on the coin rolling-down passage 25 are different from that of the lever 36 and they are actuated by solenoid plungers different from the solenoid plunger 40 for the lever 36 so as to selectively distribute different kinds of coins. Since the levers 37 and 38 are same to the lever 36 in structure and function exclusive of the aforementioned points, repeated description will not be required.

Next, coin selecting operations of the coin selector 20 constructed in the above-described manner will be described in detail below in conjunction with a structure of the same.

Figure 17:
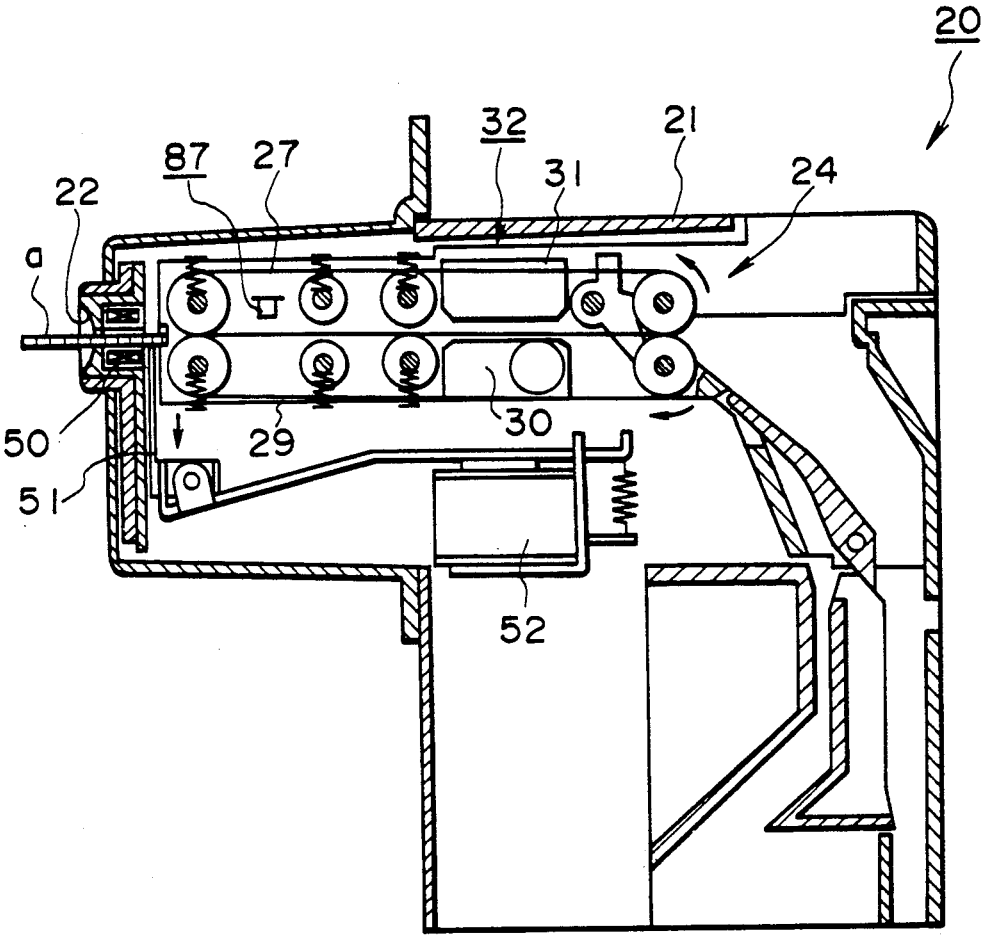
FIG. 17 to FIG. 27 are sectional views illustrating operations of the coin selector of the present invention respectively.

As shown in FIG. 17 similar to FIG. 2 wherein same components to those shown in FIG. 2 are designated by same reference numerals, when a coin a is inserted through the coin insert slit 22 of the coin selector 20, discrimination is made in response to a detection signal transmitted from the inlet sensor 50 including an oscillating coil as to whether the coin a is recognized as a coin or a foreign material such as an aluminum piece. When discrimination has been made such that the coin a is recognized as a coin, the shutter 51 which normally closes the coin insert slit 22 is slidably displaced in the downward direction by an attractive force derived from a solenoid plunger 52, whereby the coin insert slit 22 is fully opened and permits the coin a to be inserted therethrough.

Figure 18:
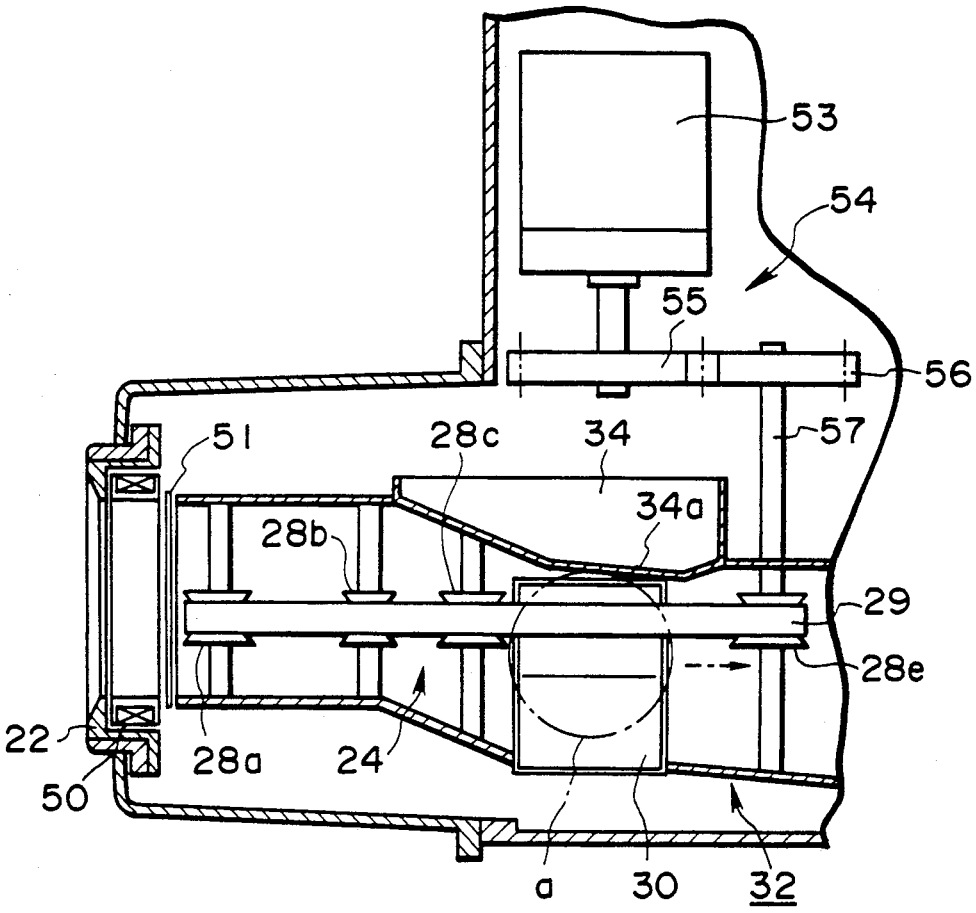

As shown in FIG. 18 similar to FIG. 3 wherein same components to those shown in FIG. 3 are designated by same reference numerals, when the downward displacement of the shutter 51 is detected by a sensor 80 shown in FIG. 2, a motor 53 for driving the horizontal coin conveying means 24 is rotated in the normal direction so that the roller 28*e* is rotated in the normal direction via gears 55 and 56 and a shaft 57 constituting a gear transmission mechanism 54, causing the coin a to be forcibly conveyed in the horizontal direction, i.e., in the rightward direction as seen in the drawing while the coin a is held between the endless belts 27 and 29 as shown in FIG. 17.

It should be noted that reliable conveyance of each coin a through the horizontal coin conveying means 24 is confirmed by a gate sensor 87 which is arranged at a predetermined position between the coin insert slit 22 and the coin discriminating means 32, i.e., at the intermediate location of the horizontal coin conveying means 24. Since the gate sensor 87 is arranged for the purpose of confirming reliable reception of the coin a at the predetermined position between the coin insert slit 22 and the coin discriminating means 32, i.e., the position where a person who has inserted the coin a can not come in contact with the coin a with his fingers by any means, there is no need of uselessly performing a coin separating operation (to be described later). This is because there arises a case where the inserted coin a is pulled back based on a mischief of the person who has inserted the coin a. In other words, a coin separating operation (to be described later) is performed after the reliable reception of the coin a is confirmed by the gate sensor 87.

Figure 19:
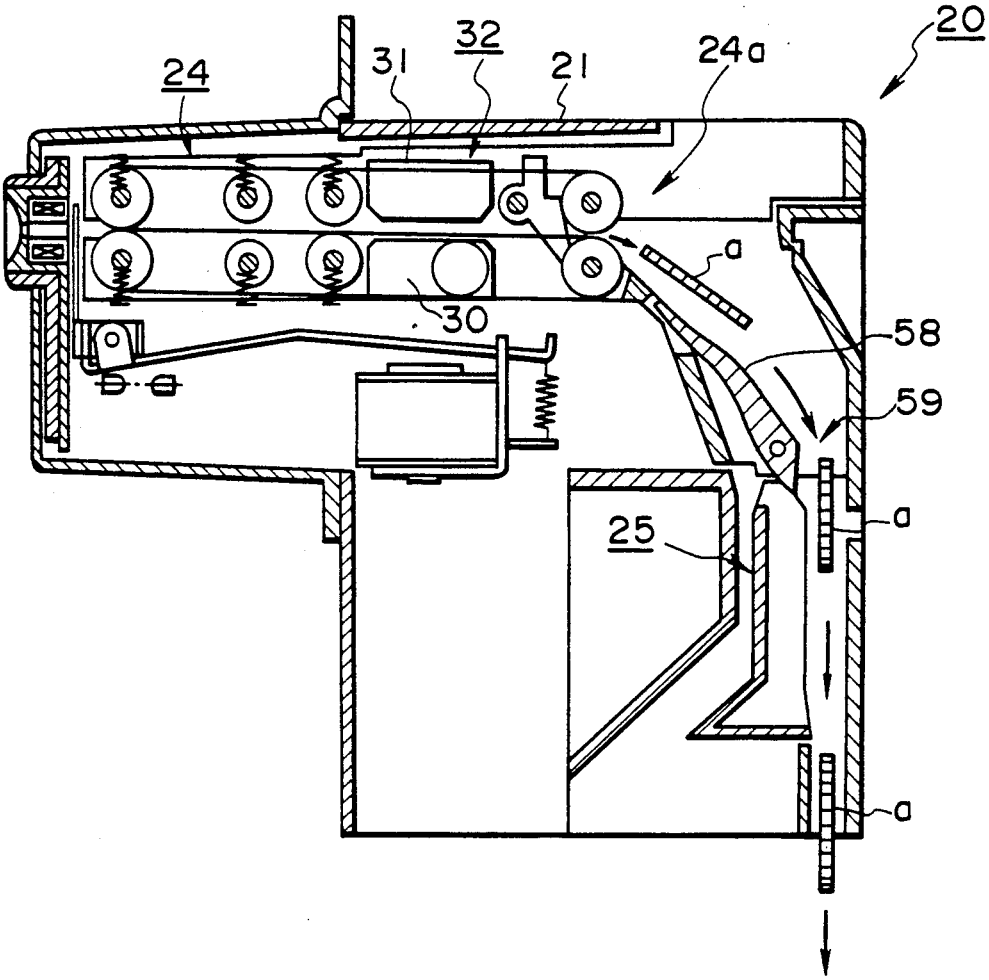

After the coin a passes past the gate sensor 87, it is conveyed further along the inclined surface 34*a* of the guide member 34 shown in FIG. 18. When the coin a passes between the oscillating coil 30 and the signal receiving coil 31 constituting the coin discriminating means 32 (see FIG. 17) with the inclined surface 34*a* as a reference position, discrimination is made in response to a signal derived from detection of the coin discriminating means 32 not only as to whether the coin a is a true coin or a false coin but also as to the kind of each coin a in a case where the coin a is recognized as a true coin. As shown in FIG. 19 similar to FIG. 17 wherein same components to those shown in FIG. 17 are designated by same reference numerals, when discrimination is made in response to the detection signal transmitted from the coin discriminating means 32 such that the coin a is a false coin, the coin a, i.e., a false coin is conducted to the false coin chute 59 along a lever 58 which normally serves to close the space between the coin discharge end 24*a* of the horizontal coin conveying means 24 and the coin rolling-down passage 25. Subsequently, the false coin is returned to a coin pay-back port (not shown).

Figure 20:
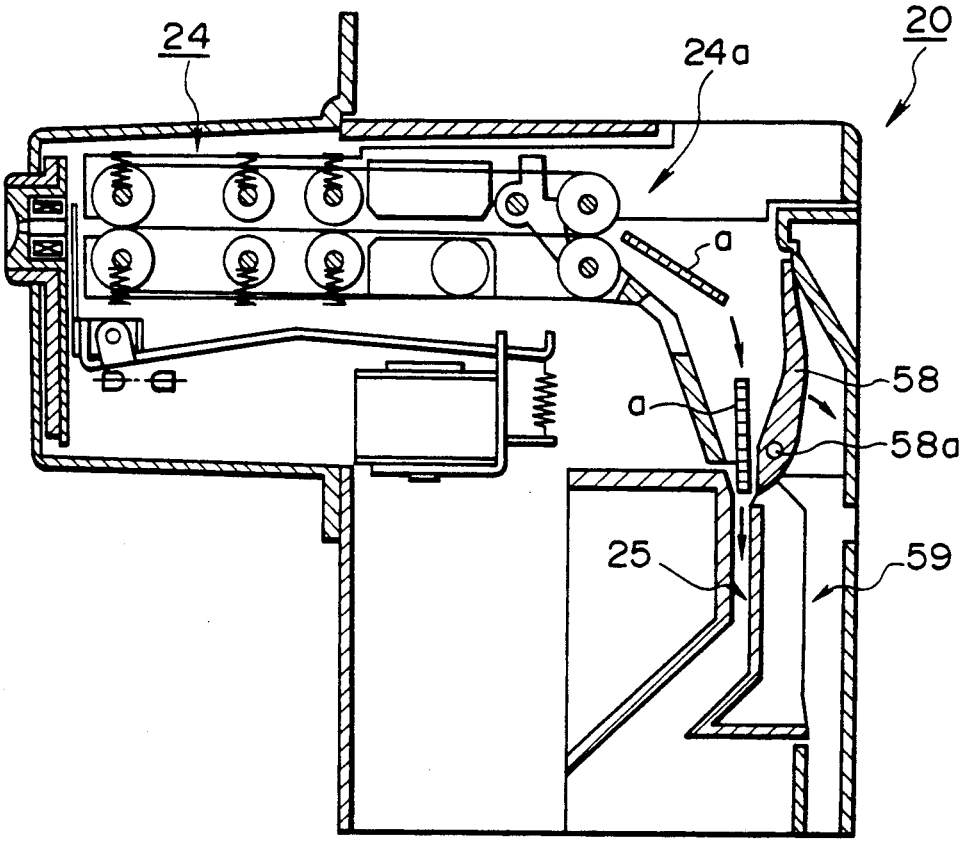

On the other hand, as shown in FIG. 20 similar to FIG. 19 wherein same components to those shown in FIG. 19 are designated by same reference numerals, when discrimination is made in response to the detection signal transmitted from the coin discriminating means 32 suc that the coin a is a true coin, the lever 58 is turned about a shaft 58*a* by a predetermined angle in the clockwise direction by an attractive force derived from a solenoid plunger (not shown), the space between the coin discharge end 24a of the horizontal coin conveying means 24 and the coin rolling-down passage 25 is opened so that the coin a which has been recognized as a true coin is introduced into the coin rolling-down passage 25.

Figure 21:
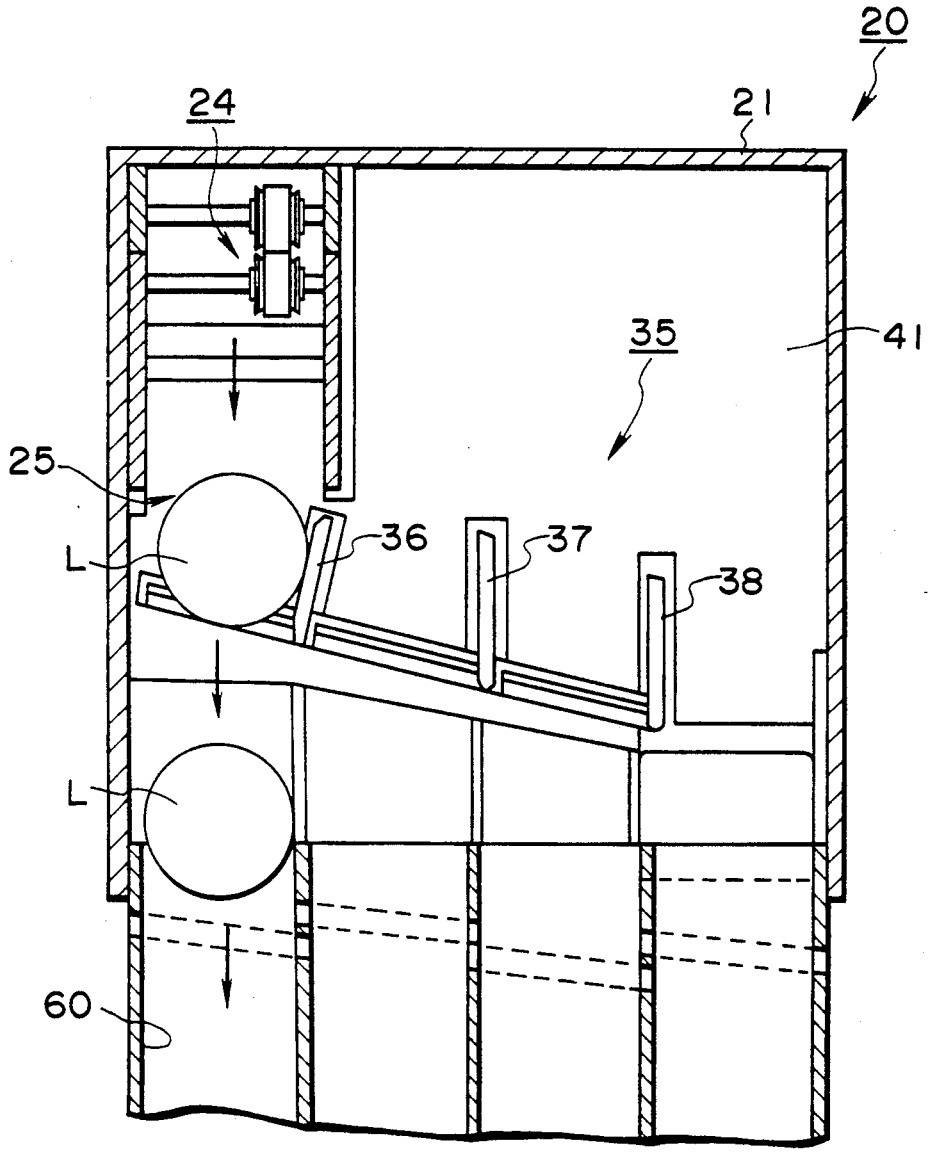

As shown in FIG. 21 similar to FIG. 8 wherein same components to those shown in FIG. 8 are designated by same reference numerals, when discrimination is made in response to a detection signal transmitted from the coin discriminating means 32 such that the coin a which has been conveyed in the horizontal direction as shown in FIG. 20 is a true coin, and moreover, it is a L coin having a largest diameter, merely the lever 36 constituting the coin distributing means 35 is attractively displaced toward the center plate 41 side with the aid of a solenoid plunger (not shown). This causes the L coin to fall downward of the coin rolling-down passage 25 at the position where the lever 36 is arranged. Then, the L coin which has been separatively distributed in the above-described manner is successively received and stored in a coin tube 60 exclusively usable for L coins.

Figure 22:
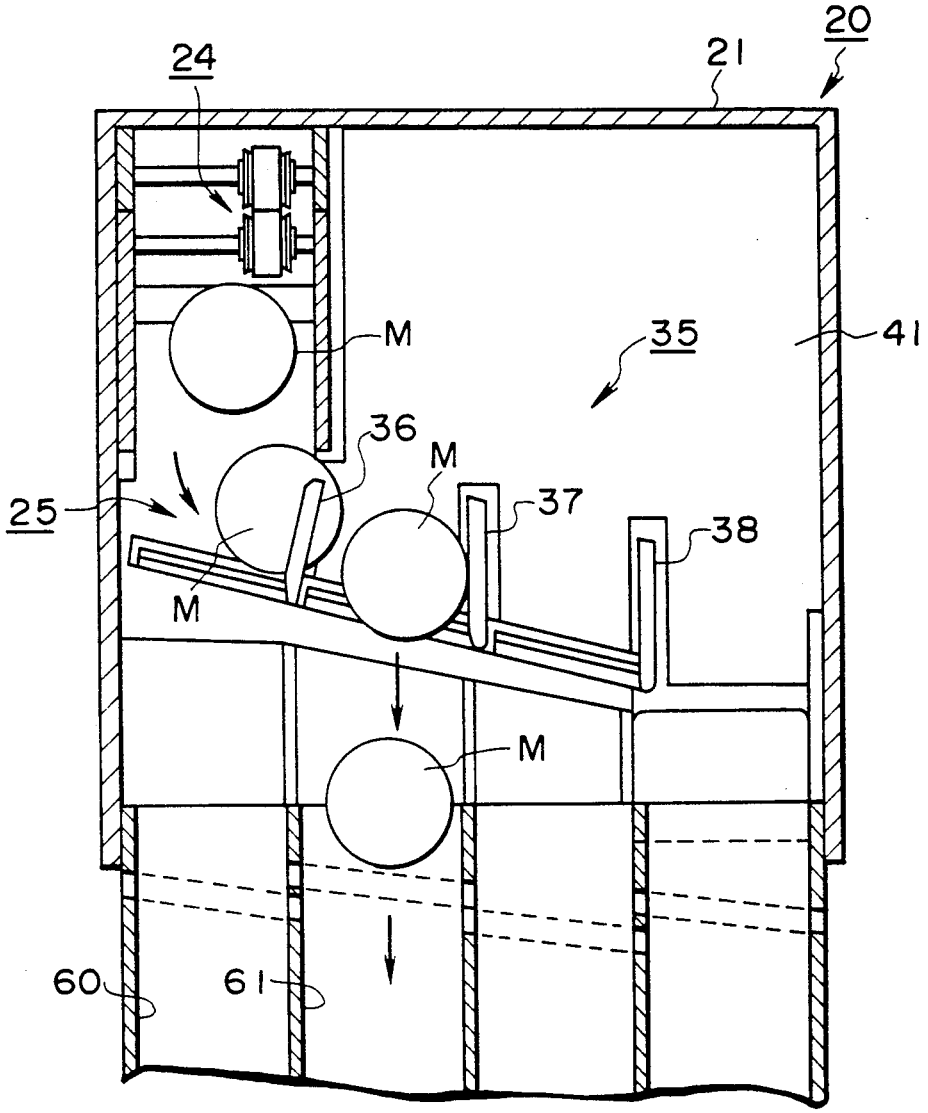

In addition, as shown in FIG. 22 similar to FIG. 8 wherein same components to those shown in FIG. 8 are designated by same reference numerals, when discrimination is made in response to a detection signal transmitted from the coin discriminating means 32 such that the coin a which has been conveyed in the horizontal direction as shown in FIG. 20 is a true coin, and moreover, it is a M coin, merely the lever 37 constituting the coin distributing means 35 is attractively displaced toward the center plate 41 side with the aid of a solenoid plunger (not shown). This causes the M coin to fall downward of the coin rolling-down passage 25 at the position where the lever 37 is arranged. Then, the M coin which has been separatively distributed in the above-described manner is successively received and stored in a coin tube 61 exclusively usable for M coins.

Figure 23:
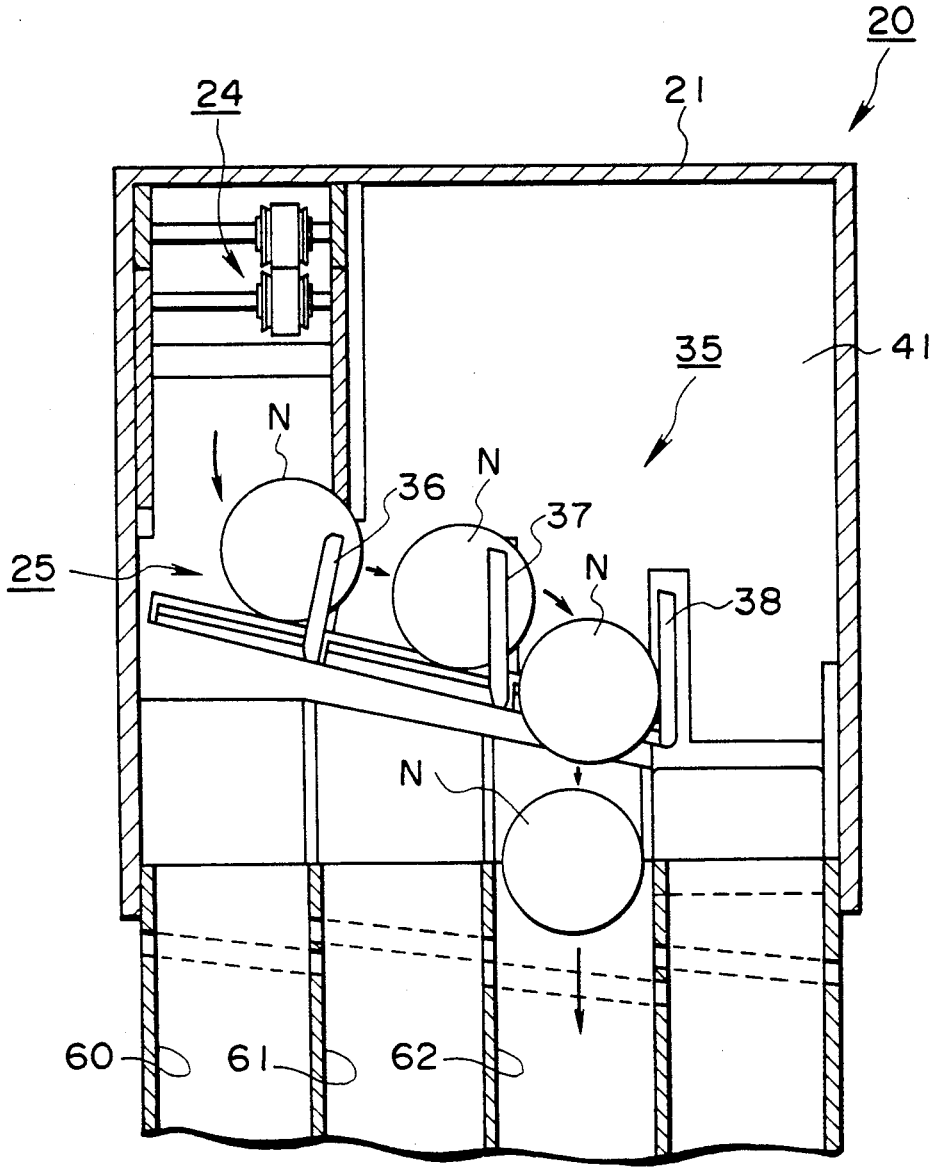

Additionally, as shown in FIG. 23 similar to FIG. 8 wherein same components to those shown in FIG. 8 are designated by same reference numerals, when discrimination is made in response to a detection signal transmitted from the coin discriminating means 32 such that the coin a which has been conveyed in the horizontal direction as shown in FIG. 20 is a true coin, and moreover, it is a N coin, merely the lever 38 is attractively displaced toward the center plate 41 side with the aid of a solenoid plunger (not shown). This causes the N coin to fall downward of the coin rolling-down passage 25 at the position where the lever 38 is arranged. Then, the N coin which has been separatively distributed in the above-described manner is successively received and stored in a coin tube 62 exclusively usable for N coins.

Figure 24:
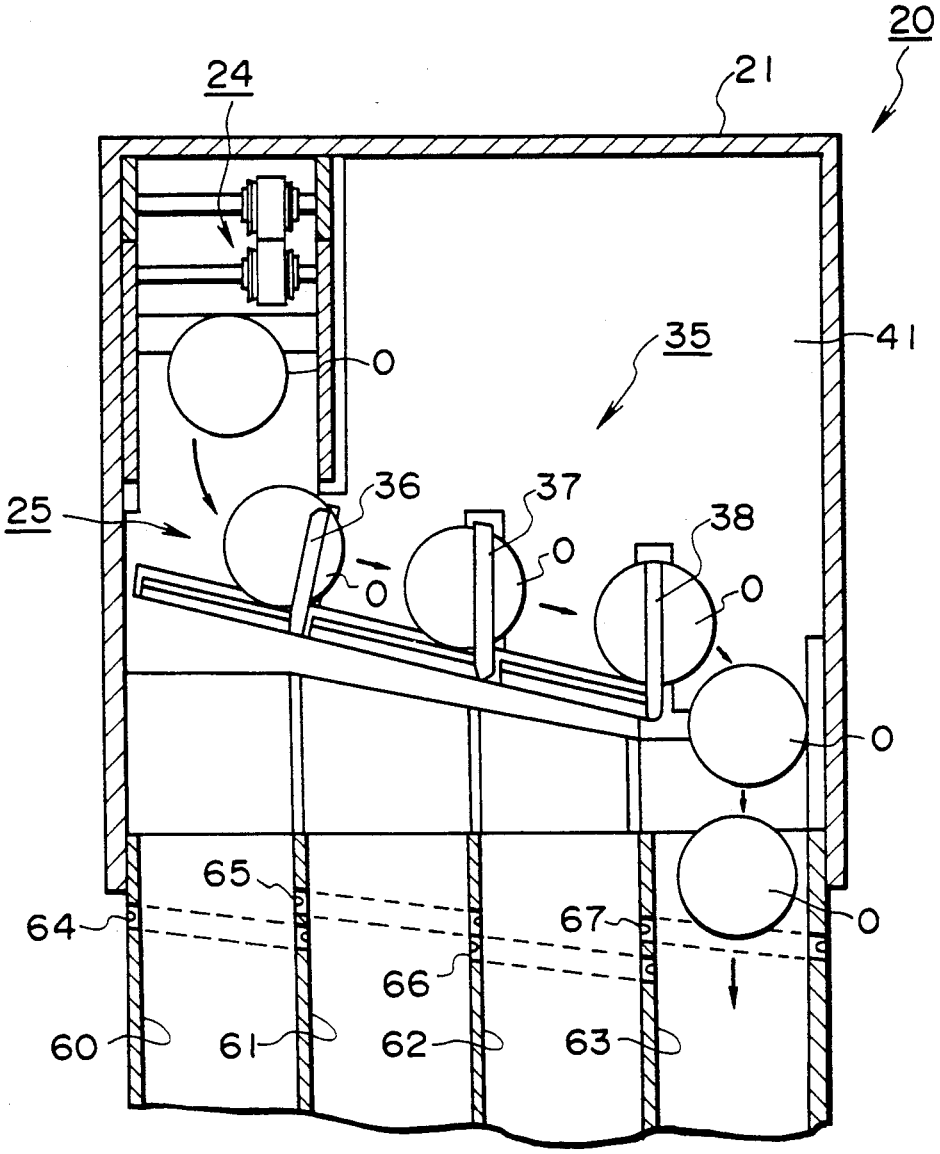

Further, as shown in FIG. 24 similar to FIG. 8 wherein same components to those shown in FIG. 8 are designated by same reference numerals, when discrimination is made in response to a detection signal transmitted from the coin discriminating means 32 such that the coin a which has been conveyed in the horizontal direction as shown in FIG. 20 is a true coin, and moreover, it is an O coin, each of the levers 36, 37 and 38 constituting the coin distributing means 35 is kept in the normal state wherein any one of them is not attractively displaced toward the center plate 41 side. This causes the O coin which has been introduced into the coin rolling-down passage 25 to fall down from the downstream end of the coin rolling-down passage 25 in the arrow-marked direction without any obstruction received from the levers 36, 37 and 38. Then, the O coin which has been distributed in the above-described manner is successively received and stored in a coin tube 63 exclusively usable for O coins.

In FIG. 24, reference numerals 64, 65, 66 and 67 designate overflow sensors mounted on the coin tubes 60, 61, 62 and 63, respectively. Each of the overflow sensors 64, 65, 66 and 67 is composed of a light emitting element such as a light emitting diode or the like and a light receiving element such as a phototransistor or the like so as to detect whether the number of coins stored in each of the coin tubes 60, 61, 62 and 63 reaches a predetermined number or not.

It should be noted that the respective overflow sensors 64, 65, 66 and 67 are mounted on the corresponding coin tubes 60, 61, 62 and 63 in the inclined state wherein they are inclined by an angle corresponding to a thickness of a single coin stored in each of the coin tubes 60, 61, 62 and 63, in order to prevent the respective overflow sensors 64, 65, 66 and 67 from being uselessly repeatedly turned on and off due to undesirable factors associated with vibration or the like.

Figure 25:
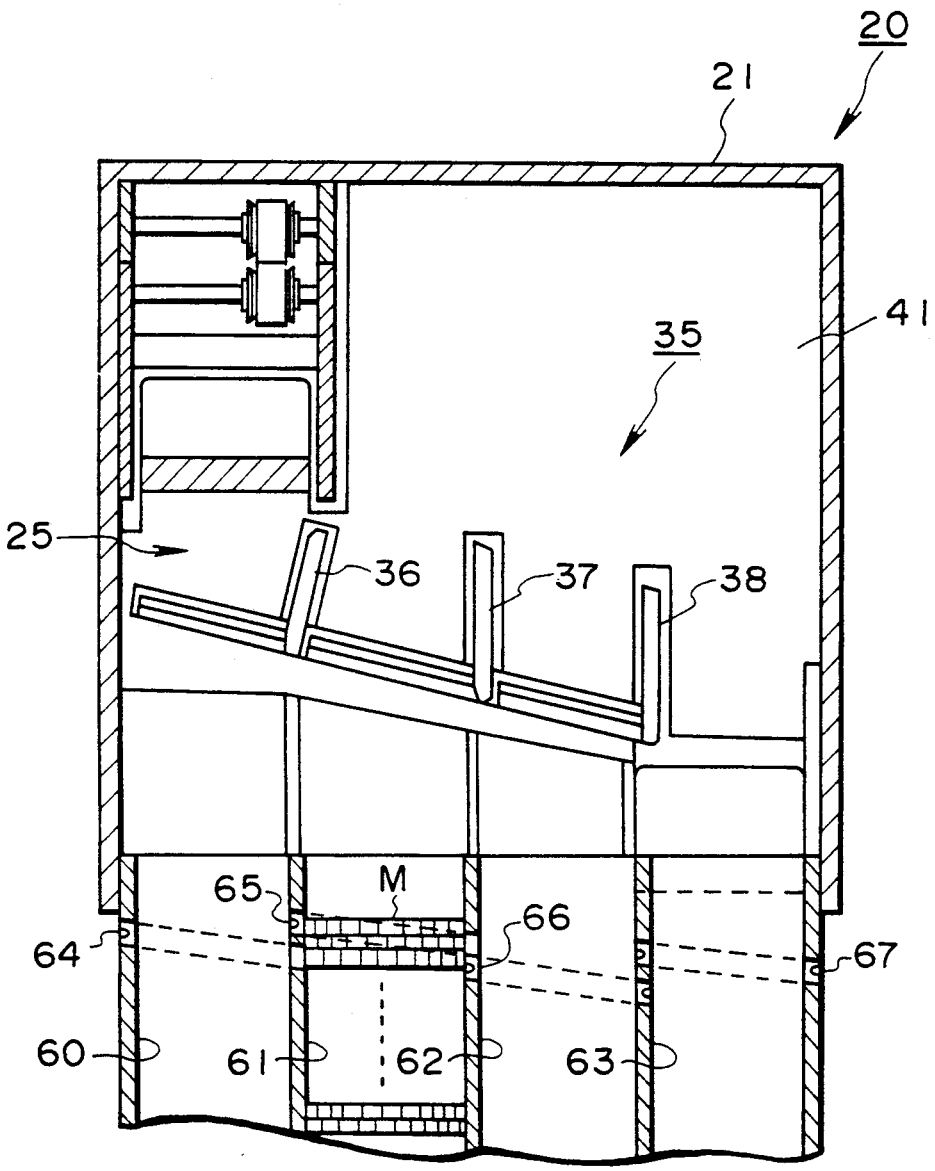
Figure 26:
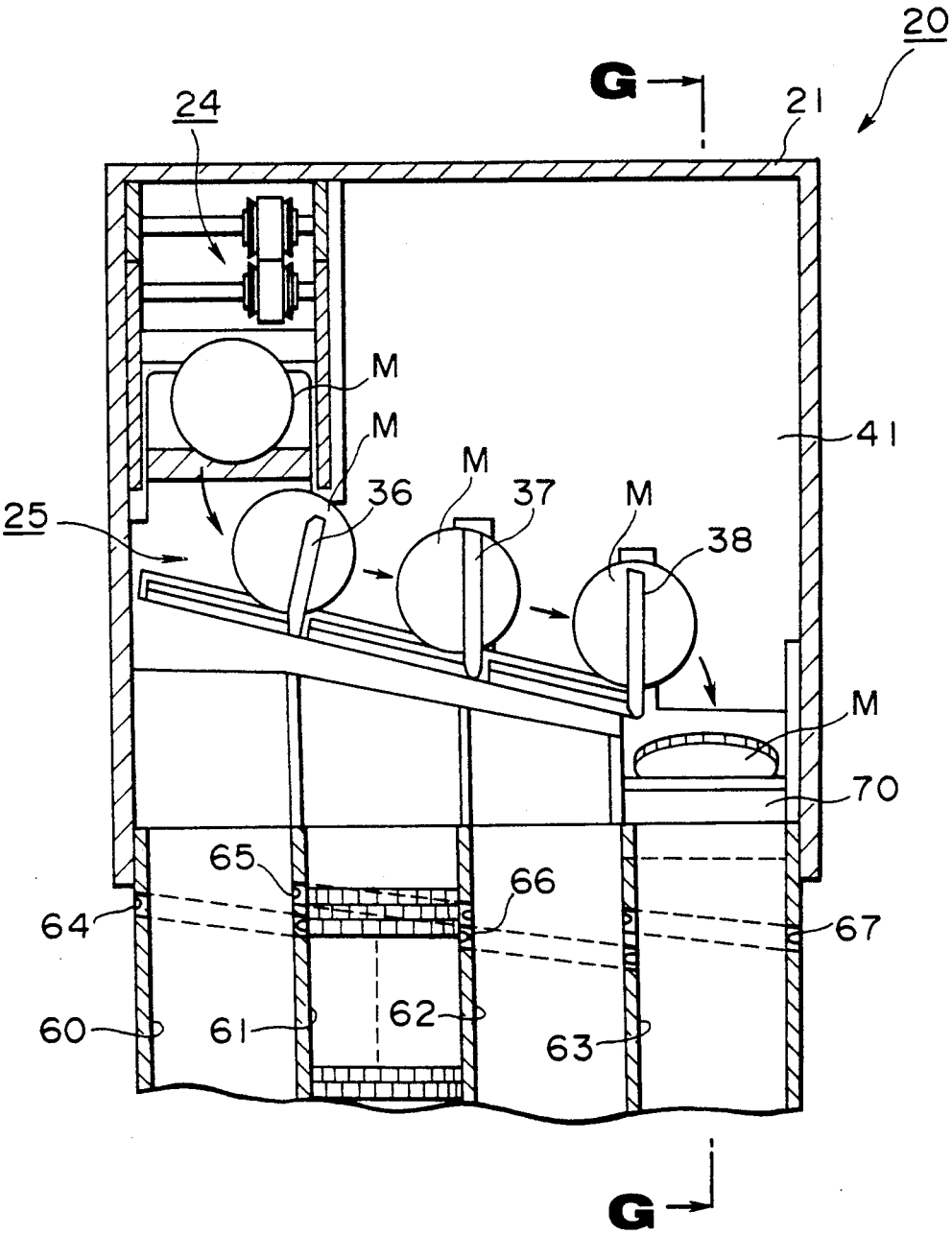

As shown in FIG. 25 similar to FIG. 24 wherein same components to those shown in FIG. 24 are designated by same reference numerals, it is assumed that e.g., the overflow sensor 65 detects that a predetermined number of M coins are received and stored in the coin tube 61. Thereafter, as shown in FIG. 26 similar to FIG. 22 wherein same components to those shown in FIG. 22 are designated by same reference numerals, when another M coin is introduced into the coin rolling-down passage 25 from the horizontal coin conveying means 24, the lever 37 is attractively displaced toward the center plate 41 side with the aid of the solenoid plunger (not shown) but it is kept in the normal state wherein the forward direction of the coin rolling-down passage 25 is opened. Since the coin tube 61 is kept filled with M coins in an overflowed state at this time, the M coin which has been additionally introduced into the coin rolling-down passage 25 is not conducted to the coin tube 61 but moves past the levers 36, 37 and 38 toward the downstream end of the coin rolling-down passage 25.

Figure 27:
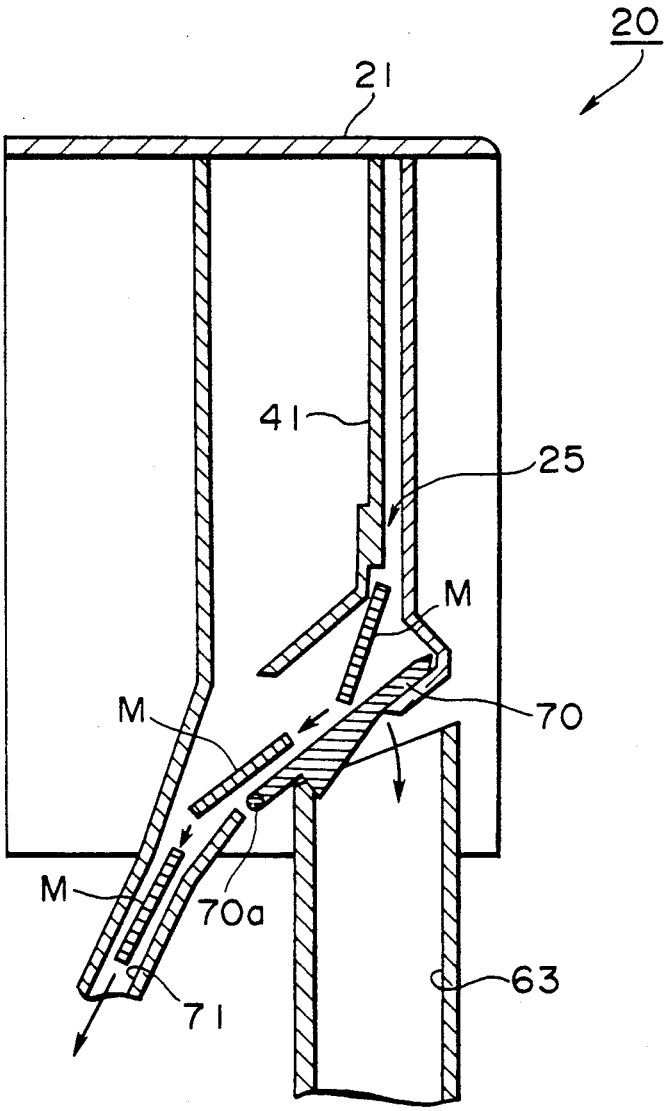

As shown in FIG. 27, i.e, a fragmentary sectional view of the coin selector 20 taken along line G—G in FIG. 26, when any one of the overflow sensors 64, 65, 66 and 67 detects that a specific kind of coins are filled in the corresponding coin tube in an overflowed state, a lever 70 which normally serves to open the space between the downstream end of the coin rolling-down passage 25 and the coin tube 63 for receiving and storing O coins is turned about a shaft 70a by a predetermined angle in the clockwise direction by an attractive force induced by a solenoid plunger (not shown), whereby the foregoing space between the downstream end of the coin rolling-down passage 25 and the coin tube 63 is closed with the lever 70. This causes an additional coin, i.e., an additional M coin which can not be stored in the corresponding coin tube which has been filled with M coins in an overflowed state to be conducted to a cash chute 71. It should be noted that the coins conducted to the cash chute 71 in the above-described manner are successively received and stored in a safe (not shown).

Figure 28:
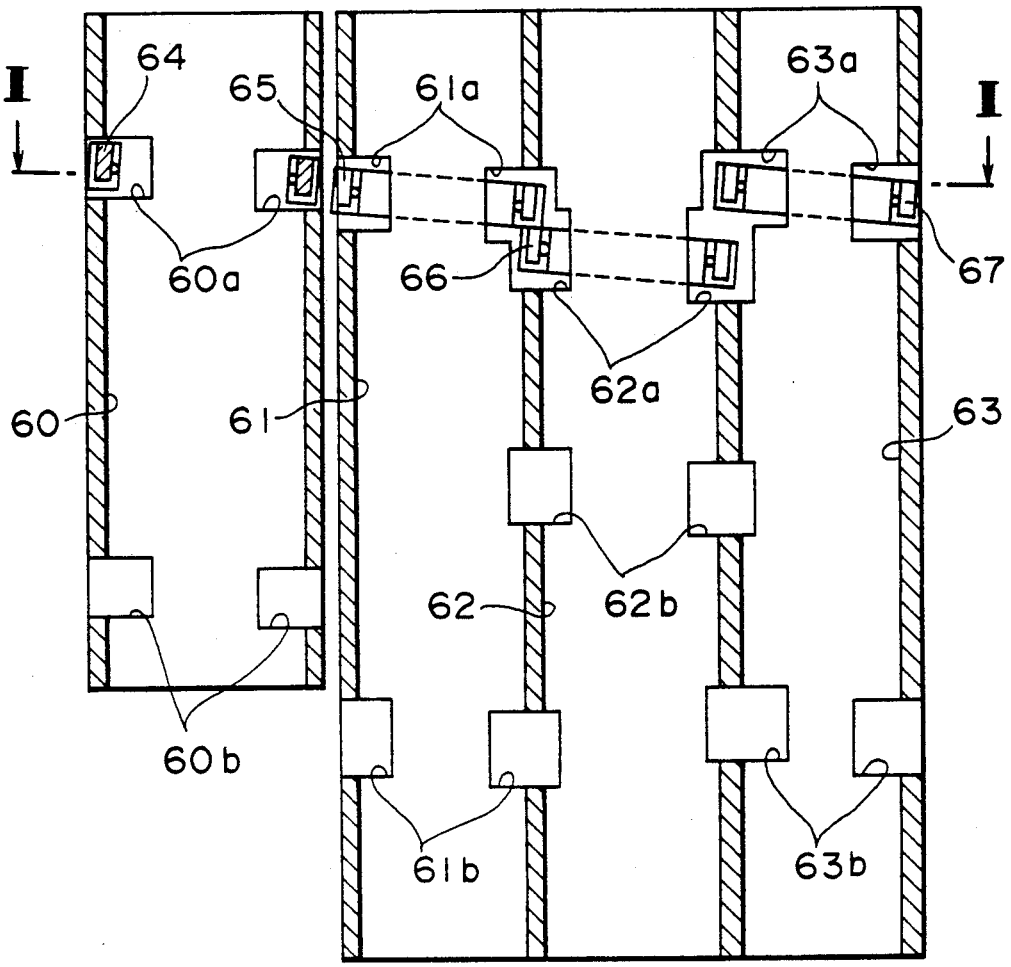
FIG. 28 to FIG. 30 are sectional views illustrating arrangement of coin tubes, respectively.
Figure 29:
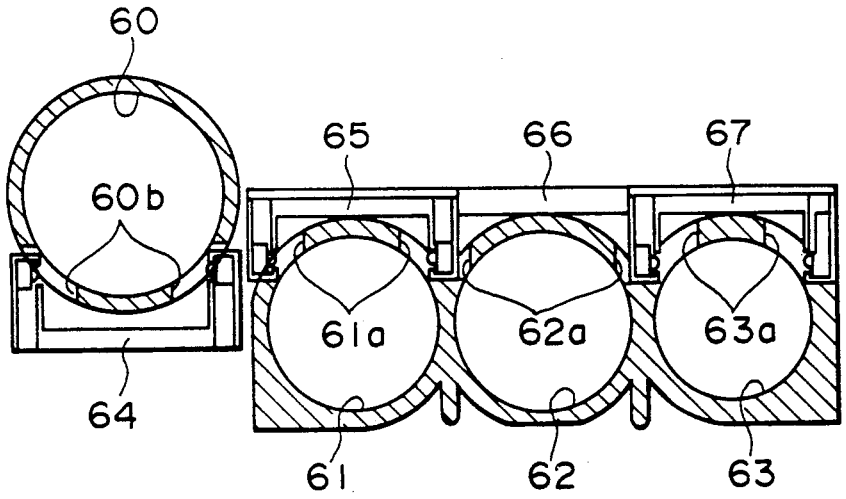

As shown in FIG. 28, i.e., an enlarged sectional view of the coin tubes, to assure that the positions where the overflow sensors 64, 65, 66 and 66 are mounted on the coin tubes 60, 61, 62 and 63 can be varied as desired, in other words, to assure that a number of coins to be received and stored in the corresponding coin tube can be adjusted as desired with respect to the respective overflow sensors 64, 65, 66 and 67, mounting holes 60*a*, 60*b*, 61*a*, 61*b*, 62*a*, 62*b*, 63*a* and 63*b* for the overflow sensors 64, 65, 66 and 67 are formed at two positions located as seen in the vertical direction of each of the coin tubes 60, 61, 62 and 63. In addition, as shown in FIG. 29, i.e., a sectional view of the coin tubes taken along line I—I in FIG. 28, the respective overflow sensors 64, 65, 66 and 67 each having a substantially U-shaped sectional contour are removably fitted into the mounting holes 60*a*, 60*b*, 60*a*, 61*b*, 62*a*, 62*b*, 63*a* and 63*b* from the front side or the rear side relative to the respective coin tubes 60, 61, 62 and 63.

Figure 30:
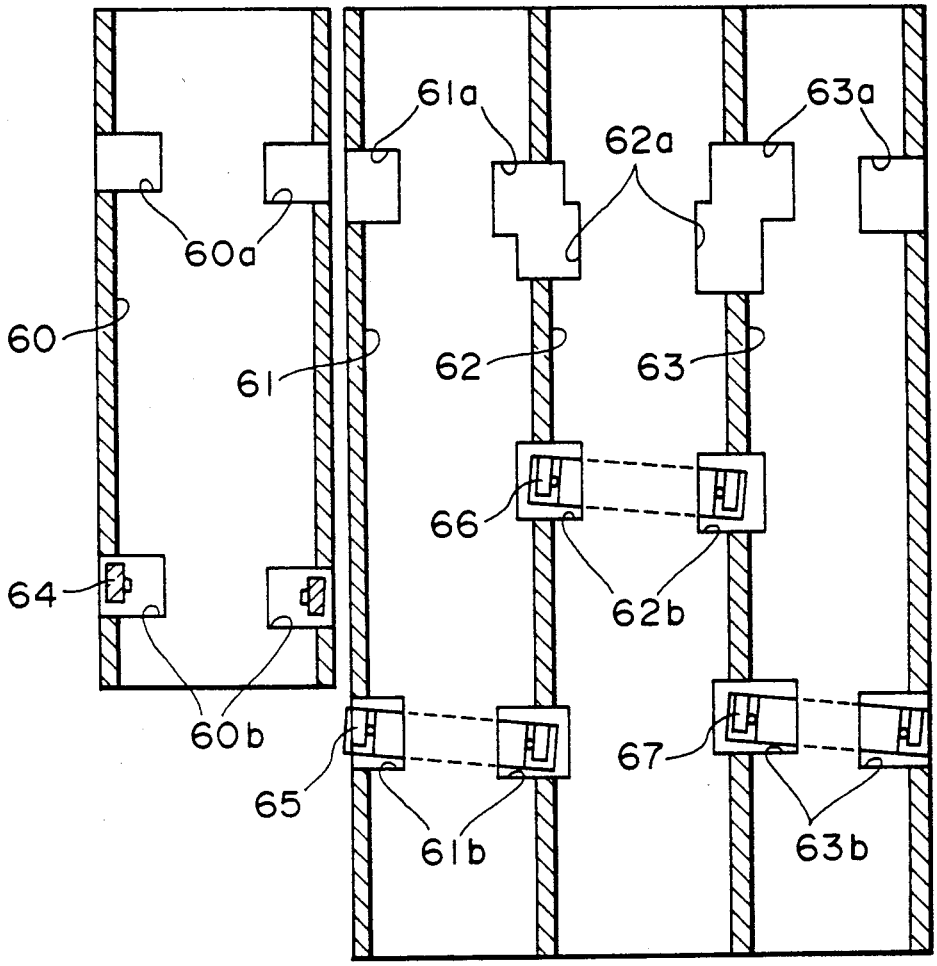

Thus, when the respective overflow sensors 64, 65, 66 and 67 are fitted into the lower mounting holes 60*b*, 61*b*, 62*b* and 63*b* as shown in FIG. 30, the number of coins to be received and stored in each of the coin tubes 60, 61, 62 and 63 can be adjusted corresponding to a method of paying a change.

It should be noted that the number of mounting holes for fitting each overflow sensor thereto should not be limited only to two locations on each coin tube as mentioned above but mounting holes may be formed at two or more locations on each coin tube.

It goes without saying that some of coins stored in each of the coin tubes 60, 61, 62 and 63 are selectively delivered to a coin pay-out port (not shown) via coin paying-out units (not shown) arranged downward of the respective coin tubes 60, 61, 62 and 63 so as to meet a requirement for a change.

Figure 33:
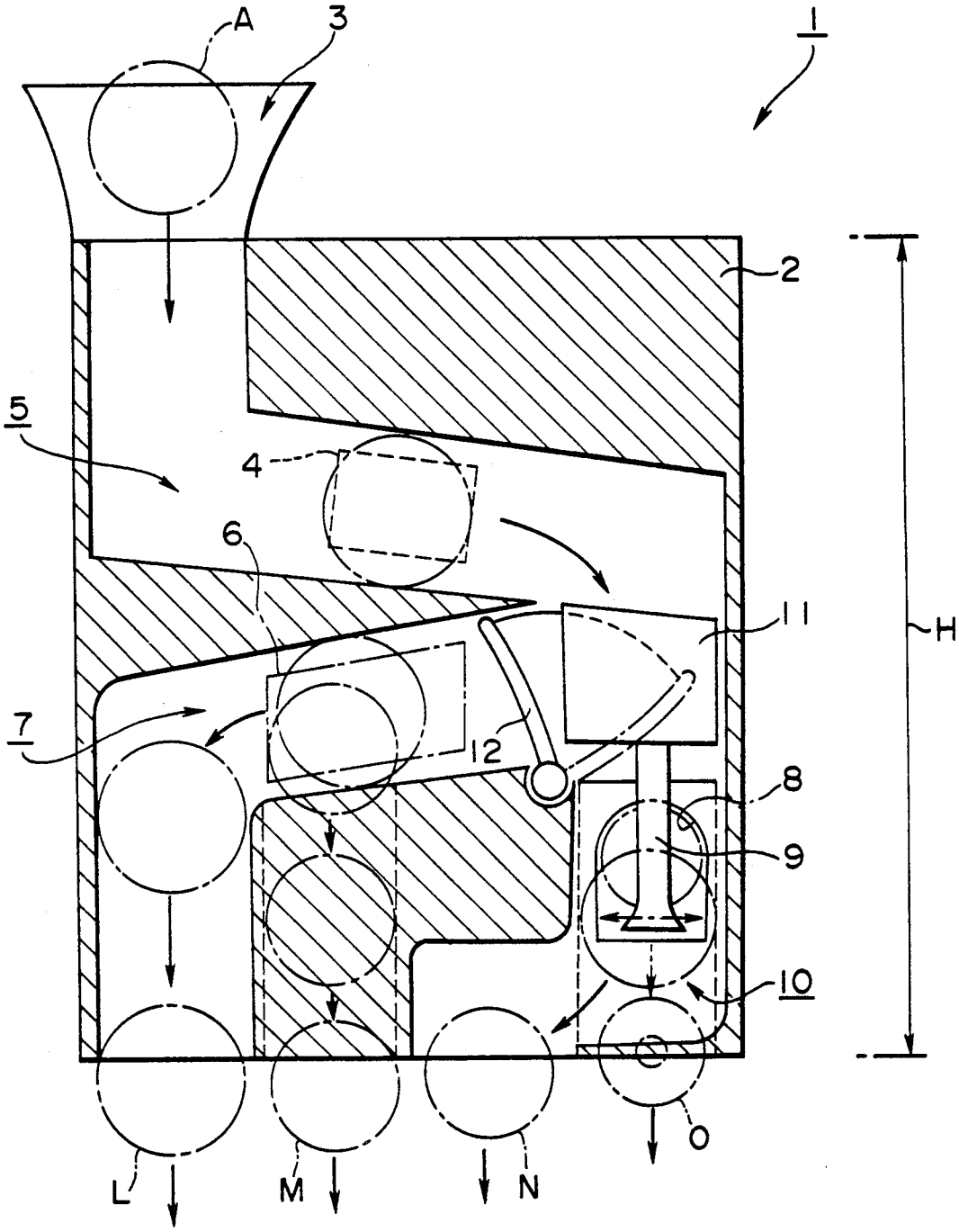
FIG. 33 PRIOR ART
FIG. 33 is a sectional view of a conventional coin selector, schematically illustrating a structure of the coin selector.
Figure 34:
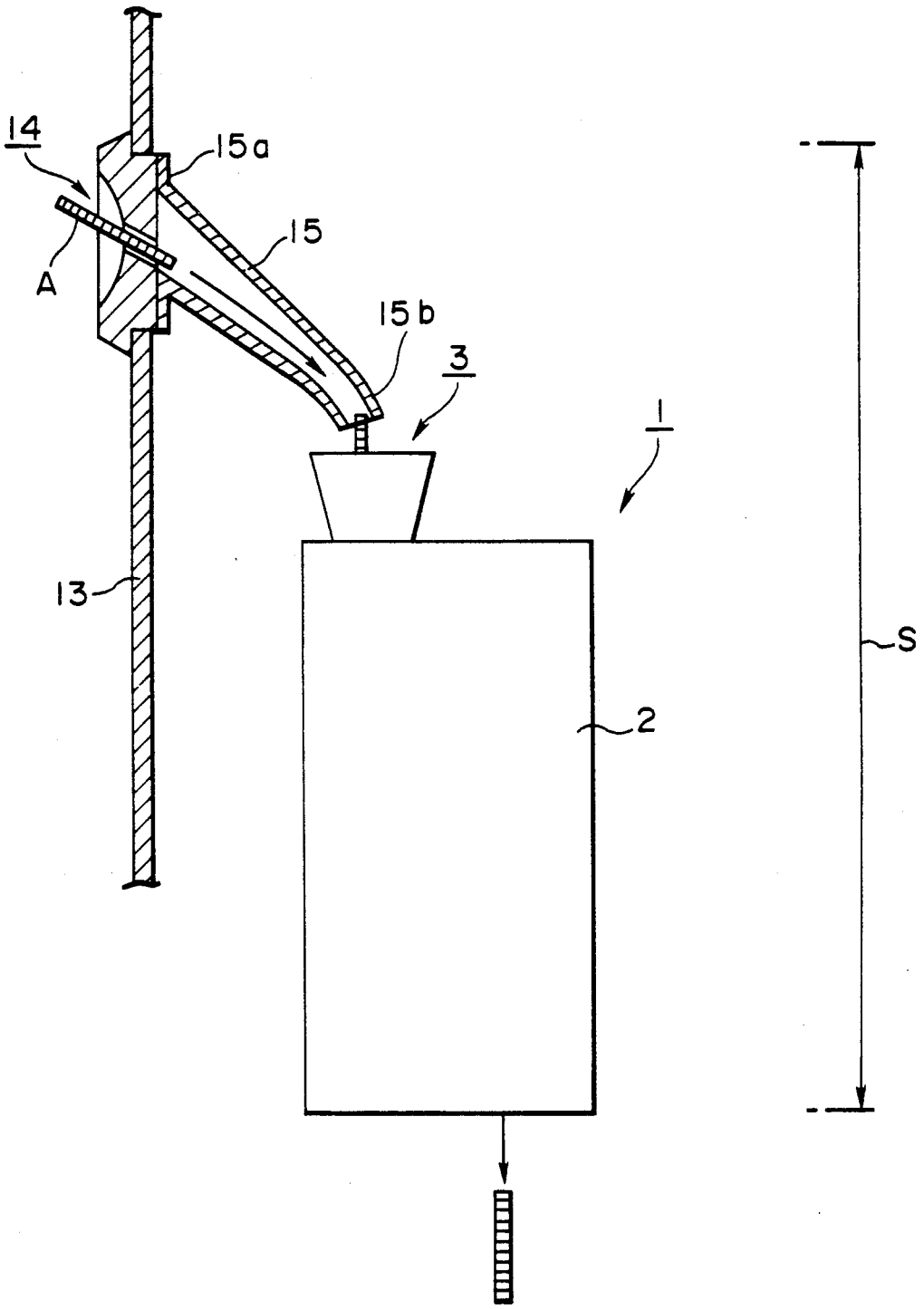
FIG. 34 PRIOR ART
FIG. 34 is a fragmentary sectional view of the conventional coin selector in FIG. 33.

As described above, according to the embodiment of the present invention, the coin selector 20 is constructed such that the coin discriminating means 32 is arranged as a first coin passage through which conveyance of an inserted coin is first guided, and moreover, the first horizontal coin conveyance passage 33 is used for properly guiding forcible horizontal conveyance of each coin through the horizontal coin conveying means 24. However, the present invention should not be limited only to this embodiment. Alternatively, the first inclined coin rolling-down passage 25 including coin discriminating means 32 which has been described above in conjunction with the conventional coin selector with reference to FIG. 33 may be used as a first coin conveyance passage for properly guiding first conveyance of an inserted coin. Even in a case where the first inclined coin rolling-down passage 5 including coin discriminating means 4 is used as shown in FIG. 33 which illustrates a conventional coin selector, it is recommendable that the first inclined coin rolling-down passage 5 including coin discriminating means 4 as shown in FIG. 33 and the second inclined coin rolling-down passage 25 including coin distributing means 35 as shown in FIG. 8 are arranged in the housing of the coin selector. Accordingly, the coin selector of the present invention does not require arrangement of many coin passages such as a second coin rolling-down passage 7, a vertical coin conveyance passage 10 or the like as shown in FIG. 33 in order to selectively distribute coins therethrough. With such construction, a dimension of the housing of the coin selector as measured in the vertical direction can be determined to be very small. In addition, a space required for mounting the coin selector in an equipment such as an automatic vending machine or the like can be reduced substantially.

The coin selector 20 of the present invention as described above is practically used for an automatic vending machine, a coin exchanger, a monetary service equipment or the like so as to receive and store inserted coins depending on the kind of coins. Additionally, the coin selector 20 constitutes a coin selecting section for a so-called coin treatment apparatus for delivering coins selectively received and stored as a change. To facilitate complete understanding of the coin treatment apparatus including the coin selector 20 of the present invention, an example of the coin treatment apparatus will be described below with reference to FIG. 31 and FIG. 32.

Figure 31:
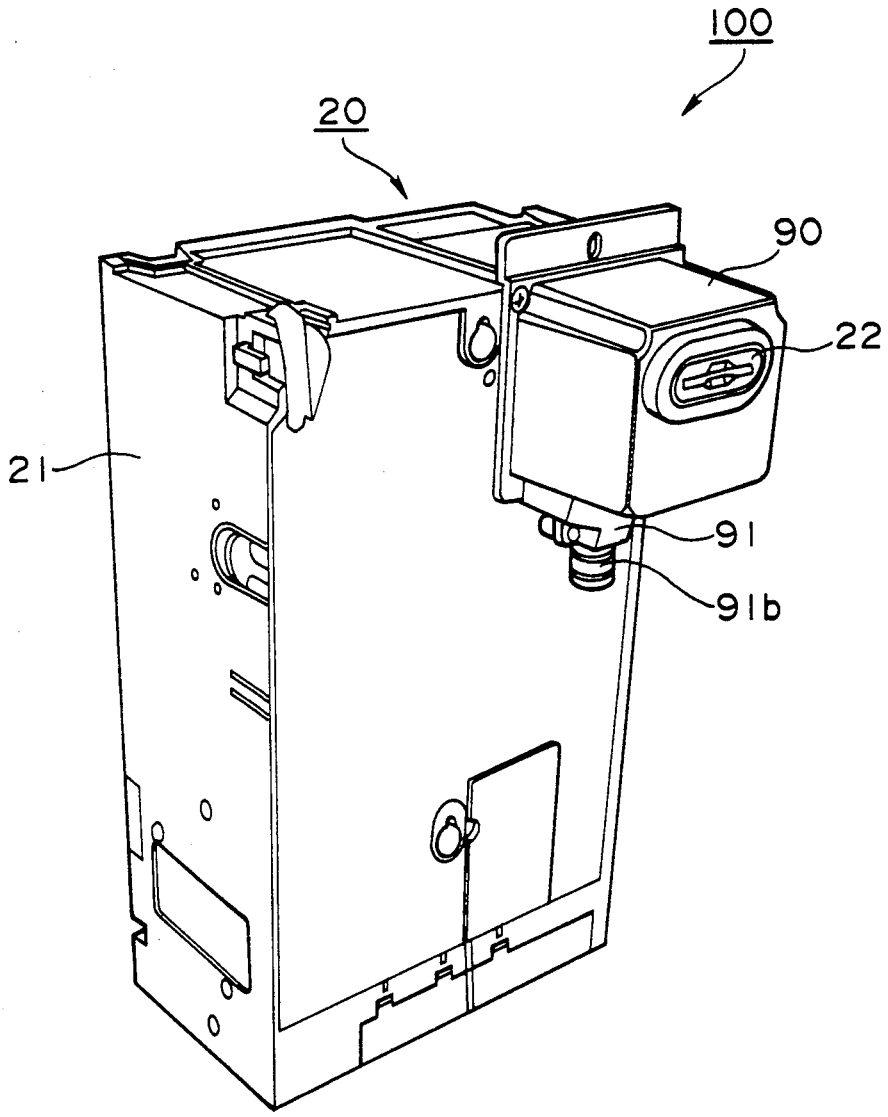
FIG. 31 is a perspective view of a coin treatment apparatus in which the coin selector of the present invention is installed, particularly illustrating a configuration of the apparatus as seen from the front side.
Figure 32:
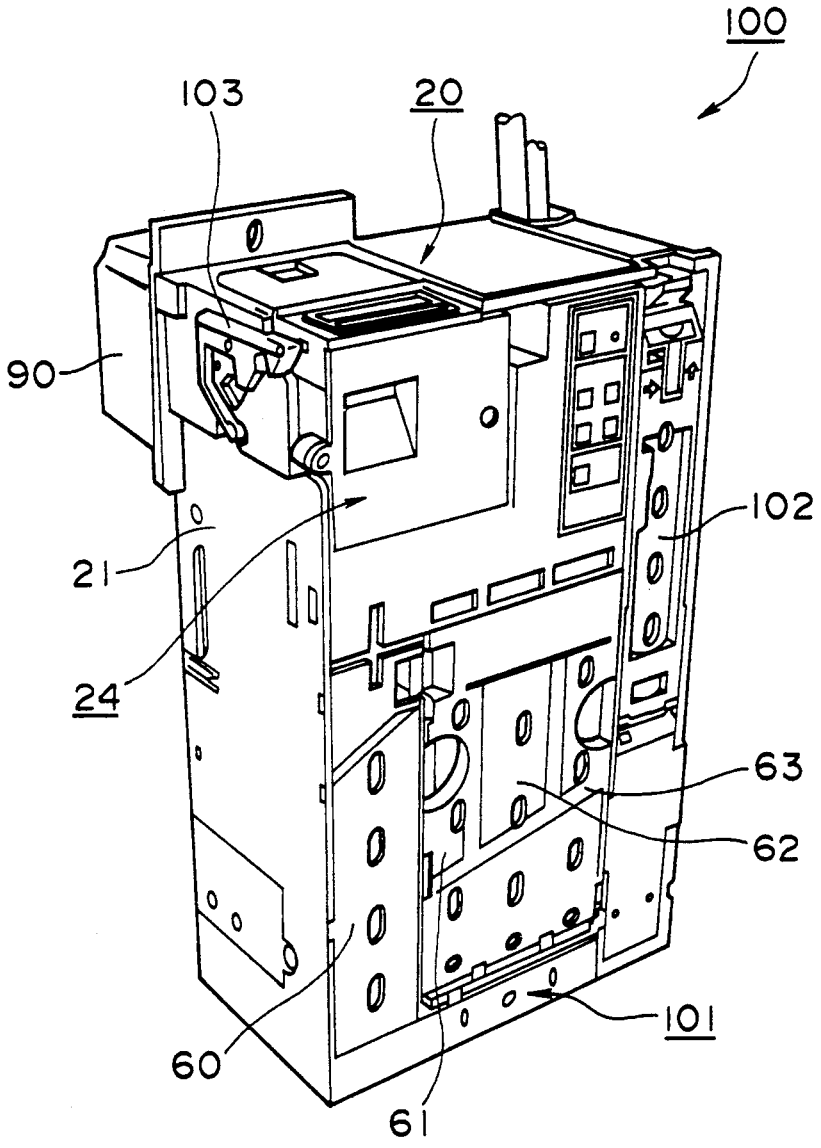
FIG. 32 is a perspective view of the coin treatment apparatus in FIG. 31, particularly illustrating the configuration of the apparatus as seen from the rear side.

FIG. 31 is a perspective view of a coin treatment apparatus 100 including the coin selector 20 of the present invention, schematically illustrating a configuration of the apparatus as seen from the front side and FIG. 32 is another perspective view of the apparatus 100, schematically illustrating the configuration of the apparatus 100 as seen from the rear side, wherein same components to those shown in FIG. 1 to FIG. 30 are designated by same reference numerals.

The coin treatment apparatus 100 is constructed integral with the housing 21 of the coin selector 20. The whole configuration and dimensions of the coin treatment apparatus 100 are determined to be amazingly compact in comparison with a conventional coin treatment apparatus including the conventional coin selector 1 as shown in FIG. 33.

Specifically, as shown in FIG. 32, an upper part of the coin treatment apparatus 100 is constituted with the coin selector 20 of the present invention, and a plurality of coin tubes 60, 61, 62 and 63 are arranged at a lower part of the apparatus 100 so as to receive and store coins selected depending on the kind of coins. In addition, a coin paying-out unit 101 including a conventional pay-out slider and others is arranged downward of the respective coin tubes 60, 61, 62 and 63 in order to pay out some of coins received and stored in the coin tubes 60, 61, 62 and 63 so as to meet a requirement for a change.

In FIG. 32, reference numeral 102 designates an auxiliary coin tube for especially receiving coins of the kind repeatedly used with a high frequency, and reference numeral 103 designates a latch for firmly holding the slidably arranged horizontal coin conveying means 24 in the housing 21 in a locked state.

As is apparent from the above description, the coin selector 20 of the present invention offers the following advantageous effects. Specifically, since a coin inserted through the coin insert slit 22 is forcibly introduced into the interior of the housing 21 of the coin selector 20 and then conveyed through the horizontal coin conveying means 24, there is no need of arranging a coin intake chute for conducting coins into the housing of the coin selector via free falling-down, when the coin selector 20 of the present invention is mounted on an equipment such as an automatic vending machine or the like. This makes it possible to substantially reduce a space required for mounting the coin selector 20 on the equipment. In contrast with the conventional coin selector, since the coin selector 20 of the present invention is provided with a single inclined coin rolling-down passage 25 including coin distributing means 35 for selectively distributing inserted coins in the vertical direction of the housing 21, there is no need of arranging many coin conveyance passages for selectively distributing coins depending on the kind of coins. Conclusively, the present invention has provided a coin selector which is constructed to have very small dimensions measured in the vertical direction.

In a case where the first inclined coin rolling-down passage 5 including coin discriminating means 4 as shown in FIG. 33 is practically used without arrangement of the horizontal coin conveying means 24, it is recommendable that the second inclined coin rolling-down passage 24 including coin distributing means 35 as shown in FIG. 8 is arranged in the housing 21 of the coin selector 20. Thus, in contrast with the conventional coin selector shown in FIG. 33, there is no need of arranging many coin conveyance passages such as a third vertical coin conveyance passage 10 or the like as seen in FIG. 33. This enables dimensions of the housing of the coin selector as measured in the vertical direction to be determined to be very small. Thus, a space required for mounting the coin selector of the present invention in the equipment such as an automatic vending machine or the like can be reduced substantially.

While the present invention has been described above with respect to a single preferred embodiment thereof, it should of course be understood that the present invention may be carried out in any other acceptable manner without departure from the spirit and purport of the invention. Therefore, the aforementioned embodiment is merely illustrative in all respects, and it should be construed that this embodiment is not limitative. In addition, the scope of the present invention should be defined by the appended claims but it should not be restricted by description of the specification at all. Additionally, it should be construed that all changes or modifications remaining within the scope of the present invention fall under the scope of the invention as defined by the appended claims.

What is claimed is:

1. A coin selector comprising:

a first inclined coin passage including coin discriminating means for discriminating whether an inserted coin is a true coin or a false coin and further discriminating denominations of coins being discriminated as true coins:

a second inclined coin passage for guiding the true coins transferred from the first coin passage; and coin distributing means including a lever having a substantially L-shaped contour as seen in a plan view and arranged to be movable from one side wall of the second coin arranged to be movable from one side wall of the second coin passage to the other side wall of the second coin passage, the L-shaped lever having an inclined surface portion which constitutes a part of a bottom surface of the second coin passage and a gate portion which intercepts the second coin passage, wherein, at a normal position, the gate portion of the lever is moved away from the one side wall of the second coin passage to allow coins to travel further along the second coin passage while the inclined surface portion of the lever is moved into the second coin passage to form part of the bottom surface of the second coin passage and, when coins discriminated as true coins by the coin discriminating means are transferred into the second coin passage, the L-shaped lever is moved toward the one side wall of the second coin passage so that the gate portion of the lever prevents coins from travelling further along the second coin passage while the inclined surface portion of the lever is moved out of the second coin passage to release the bottom surface of the second con passage, whereby the coins are dropped downward from the bottom surface of the second coin passage to different positions depending on the denominations of the true coins.

2. The coin selector as claimed in claim 1, wherein the coin discriminating means comprises an oscillating coil and a signal receiving coil arranged in a spaced relationship relative to each other with a predetermined gap therebetween.

3. The coin selector as claimed in claim 1, wherein a plurality of the coin distributing means are sequentially arranged from an upstream side to a downstream side of the second coin passage at positions differing depending on the denominations of the true coins.

4. A coin selector comprising:

a first inclined coin passage including coin discriminating means for discriminating whether an inserted coin is a true coin or a false coin and further discriminating denominations of coins being discriminated as true coins;:

a second inclined coin passage for guiding the true coins transferred from the first coin passage; and coin distributing means including a lever having a substantially L-shaped contour as seen in a plan view and arranged to be movable from one side wall of the second coin passage to the other side wall of the second coin passage, the L-shaped lever having an inclined surface portion which constitutes a part of a bottom surface of the second coin passage and a gate portion which intercepts the second coin passage, wherein, at a normal position, the gate portion of the lever is moved away from the one side wall of the second coin passage to allow coins to travel further along the second coin passage while the inclined surface portion of the lever is moved into the second coin passage to form part of the bottom surface of the second coin passage and, when coins discriminated as true coins by the coin discriminating means are transferred into the second coin passage, the L-shaped lever is moved toward the one side wall of the second coin passage so that the gate portion of the lever prevents coins from travelling further along the second coin passage while the inclined surface portion of the lever is moved out of the second coin passage to release the bottom surface of the second coin passage, whereby the coins are dropped downward from the bottom surface of the second coin passage to different positions depending on the denominations of the true coins; and a plurality of coin tubes detachably arranged below the second coin passage for receiving the coins distributed by the coin distributing means in accordance with the denominations of the coins.

5. The coin selector as claimed in claim 4, wherein the coin discriminating means comprises an oscillating coil and a signal receiving coil arranged in a spaced relationship relative to each other with a predetermined gap therebetween.

6. The coin selector as claimed in claim 4, wherein a plurality of the coin distributing means are sequentially arranged from an upstream side to a downstream side of the second coin passage at the positions differing depending on the denominations of the true coins.

7. The coin selector as claimed in claim 4, wherein each of the c in tubes is removably equipped with an overflow sensor which serves to detect whether a predetermined number of coins are received and stored in a corresponding coin tube.

8. The coin selector as claimed in claim 7, wherein each of the overflow sensors comprises a light emitting element and a light receiving element which are arranged on each of the coin tubes in such a manner that one of the elements is higher than the other of the elements by a distance corresponding to a thickness of a single coin to be stored.

9. The coin selector as claimed in claim 8, wherein each of the coin tubes has a plurality of mounting holes formed in a vertical direction for changing a mounting position of a corresponding overflow sensor so as to adjust the number of coins causing an overflow state to be reached.

10. A coin selector comprising:

horizontal coin conveying means for forcibly conveying a coin inserted through a coin insert slit in a horizontal direction;

coin discriminating means arranged at an intermediate position of the horizontal coin conveying means for discriminating whether the conveyed coin is a true coin or a false coin and also discriminating denominations of coins being discriminated as true coins;

a single inclined coin rolling-down passage for guiding the true coins conveyed from the horizontal coin conveying means; and coin distributing means including a lever having a substantially L-shaped contour as seen in a plan view and arranged to be movable from one side wall of the single inclined coin rolling-down passage to the other side wall of the single inclined coin rolling-down passage, the L-shaped lever having an inclined surface portion which constitutes a part of a bottom surface of the single inclined coin rolling-down passage and a gate portion which intercepts the single inclined coin rolling-down passage, wherein, at a normal position, the gate portion of the lever is moved away from the one side wall of the single inclined coin rolling-down passage to allow coins to travel further along the single inclined coin rolling-down passage while the inclined surface portion of the lever is moved into the single inclined coin rolling-down passage to form part of the bottom surface of the single inclined coin rolling-down passage and, when coins discriminated as true coins by the coin discriminating means are transferred into the single inclined coin rolling-down passage, the L-shaped lever is moved toward the one side wall of the single inclined coin rolling-down passage so that the gate portion of the lever prevents coins from travelling further along the single inclined coin rolling-down passage while the inclined surface portion of the lever is moved the single inclined coin rolling-down passage to release the bottom surface of the single inclined coin rolling-down passage, whereby the coins are dropped downward from the bottom surface of the single inclined coin rolling-down passage to different positions depending on the denominations of the true coins.

11. The coin selector as claimed in claim 10, wherein an inlet sensor is arranged peripheral to the coin insert slit so as to determine whether a substance inserted through the coin insert slit is a coin or not.

12. The coin selector as claimed in claim 11, wherein a shutter is arranged at a position adjacent to the coin insert slit so as to open or close the coin insert slit based on the determination made by the inlet sensor.

13. The coin selector as claimed in claim 10, wherein a gate sensor is arranged at an intermediate position of the horizontal coin conveying means between the coin insert slit and the coin discriminating means so as to confirm whether the coin inserted through the coin insert slit is present or not.

14. The coin selector as claimed in claim 10, wherein a coin guide member is arranged at an intermediate position of the horizontal coin conveying means where the coin discriminating means is arranged, for guiding each coin along a same locus when each coin passes through the coin discriminating means.

15. The coin selector as claimed in claim 10, wherein the horizontal coin conveying means comprises a pair of endless belts arranged opposite to each other so as to hold a coin therebetween.

16. The coin selector as claimed in claim 10, wherein the horizontal coin conveying means comprises a pair of endless belts arranged opposite to each other so as to hold a coin therebetween, wherein the whole horizontal coin conveying means is slidably arranged in a housing of the coin selector and wherein the pair of endless belts are arranged to pivotably open about one end thereof.

17. The coin selector as claimed in claim 10, wherein an upstream end of the horizontal coin conveying means is covered with a cover in which the coin inset slit is received.

18. The coin selector as claimed in claim 17, wherein the coin insert slit received in the cover is secured to a door for equipment such as an automatic vending machine.

19. The coin selector as claimed in claim 18, wherein a liquid collecting portion is arranged on a bottom surface of the cover so as to collect a liquid introduced through the coin insert slit and then discharge the liquid to the outside.

20. The coin selector as claimed in claim 19, wherein the liquid collecting portion comprises a casing having a funnel-shaped sectional contour with a hole formed on an upper surface thereof for allowing the liquid to flow into the liquid collecting portion therethrough and with another hole formed on a lower surface thereof for allowing the collected liquid to be discharged from the liquid collecting portion to the outside therethrough.

21. The coin selector as claimed in claim 10, wherein the coin discriminating means comprises an oscillating coil and a signal receiving coin arranged in the spaced relationship relative to each other with a predetermined gap therebetween.

22. The coin selector as claimed in claim 10, wherein a plurality of the coin distributing means are sequentially arranged from an upstream side to a downstream side of the coin passage at positions differing depending on the denominations of the true coins.

23. A coin selector comprising:

horizontal coin conveying means for forcibly conveying a coin inserted through a coin insert slit in a horizontal direction;

coin discriminating means arranged at an intermediate position of the horizontal coin conveying means for discriminating whether the conveyed coin is a true coin or a false coin and also discriminating denominations of coins being discriminated as true coins;

a single inclined coin rolling-down passage for guiding the true coins conveyed from the horizontal coin conveying means; coin distributing means including a lever having a substantially L-shaped contour as seen in a plan view and arranged to be movable from one side wall of the single inclined coin rolling-down passage to the other side wall of the single inclined coin rolling-down passage, the L-shaped lever having an inclined surface portion which constitutes a part of a bottom surface of the single inclined coin rolling-down passage and a gate portion which intercepts the single inclined coin rolling-down passage, wherein, at a normal position, the gate portion of the lever is moved away from the one side wall of the single inclined coin rolling-down passage to allow coins to travel further along the single inclined coin rolling-down passage while the inclined surface portion of the lever is moved into the single inclined coin rolling-down passage to form part of the bottom surface of the single inclined coin rolling-down passage and, when coins discriminated as true coins by the coin discriminating means are transferred into, the single inclined coin rolling-down passage, the L-shaped lever is moved toward the one side wall of the single inclined coin rolling-down passage so that the gate portion of the lever prevents coins from travelling further along the single inclined coin rolling-down passage while the inclined surface portion of the lever is moved out of the single inclined coin rolling-down passage to release the bottom surface of the single inclined coin rolling-down passage, whereby the coins are dropped downward from the bottom surface of the single inclined coin rolling-down passage to different positions depending on the denominations of the true coins; and a plurality of coin tubes detachably arranged below the single inclined coin rolling-down passage, each of the coin tubes serving to receive each coin distributed by the coin distributing means in a corresponding coin tube depending on the denominations of the true coins.

24. The coin selector as claimed in claim 23, wherein an inlet sensor is arranged peripheral to the coin insert slit so as to determine whether a substance inserted through the coin insert slit is a coin or not.

25. The coin selector as claimed in claim 24, wherein a shutter is arranged at a position adjacent to the coin insert slit so as to open or close the coin insert slit based on the determination made by the inlet sensor.

26. The coin selector as claimed in claim 23, wherein a gate sensor is arranged at an intermediate position of the horizontal coin conveying means between the coin insert slit and the coin discriminating means so as to confirm whether the coin inserted through the coin insert slit is present or not.

27. The coin selector as claimed in claim 23, wherein a coin guide member is arranged at an intermediate position of the horizontal coin conveying means where the coin discriminating means is arranged, for guiding each coin along a same locus when each coin passes through the coin discriminating means.

28. The coin selector as claimed in claim 23, wherein the horizontal coin conveying means comprises a pair of endless belts arranged opposite to each other so as to hold a coin therebetween.

29. The coin selector as claimed in claim 23, wherein the horizontal coin conveying means comprises a pair of endless belts arranged opposite to each other so as to hold a coin therebetween, wherein the whole horizontal coin conveying means is slidably arranged in a housing of the coin selector and wherein the pair of endless belts are arranged to pivotably open about one end thereof.

30. The coin selector as claimed in claim 23, wherein an upstream end of the horizontal coin conveying means is covered with a cover in which the coin insert slit is received.

31. The coin selector as claimed in claim 30, wherein the coin insert slit received in the cover is secured to a door of an equipment such as an automatic vending machine.

32. The coin selector as claimed in claim 31, wherein a liquid collecting portion is arranged on a bottom surface of the cover so as to collect a liquid introduced through the coin insert slit and then discharge the liquid to the outside.

33. The coin selector as claimed in claim 32, wherein the liquid collecting portion comprises a casing having a funnel-shaped sectional contour with a hole formed on an upper surface thereof for allowing the liquid to flow into the liquid collecting portion therethrough and with another hole formed on a lower surface thereof for allowing the collected liquid to be discharged from the liquid collecting portion to the outside therethrough.

34. The coin selector as claimed in claim 23, wherein the coin discriminating means comprises an oscillating coil and a signal receiving coil arranged in a spaced relationship relative to each other with a predetermined gap therebetween.

35. The coin selector as claimed in claim 23, wherein a plurality of the coin distributing means are sequentially arranged from an upstream side to a downstream side of the single inclined coin rolling-down passage at positions differing depending on the denominations of the true coins.

36. The coin selector as claimed in claim 23, wherein each of the coin tubes is removably equipped with an overflow sensor which serves to detect whether a predetermined number of coins are received and stored in the corresponding coin tube.

37. The coin selector as claimed in claim 36, wherein each of the overflow sensors comprises a light emitting element and a light receiving element which are arranged on each of said coin tubes in such a manner that one of the elements is higher than the other of the elements by a distance corresponding to a thickness of a single coin to be stored.

38. The coin selector as claimed in claim 37, wherein each of the coin tubes has a plurality of mounting holes formed in a vertical direction for changing a mounting position of a corresponding overflow sensor so as to adjust the number of coins causing an overflow state to be reached.

* * * * *